United States Patent [19]

Wein

[11] Patent Number: 5,044,503

[45] Date of Patent: Sep. 3, 1991

[54] BOX GLUING ARRANGEMENT

[76] Inventor: Sam Wein, 5061 Aegina Way, Oceanside, Calif. 92056

[21] Appl. No.: 356,932

[22] Filed: May 24, 1989

Related U.S. Application Data

[63] Continuation-in-part of Ser. No. 163,692, Mar. 3, 1988, abandoned, which is a continuation-in-part of Ser. No. 103,849, Oct. 1, 1987, abandoned.

[51] Int. Cl.[5] ..... B65D 5/70

[52] U.S. Cl. ..... 206/621.3; 206/620; 206/621.4; 206/621.6; 206/621.7; 206/626; 206/631.2

[58] Field of Search ..... 206/620, 634, 621.3, 206/621.4, 621.6, 621.7, 626, 628, 631.2

[56] References Cited

U.S. PATENT DOCUMENTS

| | | | |
|---|---|---|---|
| 2,020,680 | 11/1935 | Forrer | 206/621.7 |
| 2,217,142 | 10/1940 | Stedman | 206/626 |
| 4,317,518 | 3/1982 | Mode | 206/626 |
| 4,429,828 | 2/1984 | Färber | 206/634 |

FOREIGN PATENT DOCUMENTS

| | | | |
|---|---|---|---|
| 2912717 | 10/1980 | Fed. Rep. of Germany | 206/626 |
| 8403746 | 7/1986 | Netherlands | 206/621.4 |
| 565842 | 11/1944 | United Kingdom | 206/621.3 |
| 632222 | 11/1949 | United Kingdom | 206/621.3 |
| 2045723 | 11/1980 | United Kingdom | 206/626 |

*Primary Examiner*—Gary E. Elkins

*Attorney, Agent, or Firm*—Richard F. Carr; Richard L. Gausewitz; Allan Rothenberg

[57] ABSTRACT

The box construction includes superimposed layers or flaps each of which has a cut partially through it from the surface adjacent the other, the cuts being aligned. Glue within the cuts holds these box portions together, allowing them to be separated by tearing out only the part within one of the cuts, resulting in a neat appearance without loose shreds. Alternatively, the inner layer may be cut all the way through around an enclosed periphery, held to the remainder of the layer by at least one uncut segment interrupting the cut. Glue within the periphery secures the inner layer to the outer. When the layers are separated, the center within the periphery of the cut is torn out, adhering to the outer layer. The layers may be returned to their original positions where the center enters the cut and holds the layers together by friction. Box closures and spouts are included.

23 Claims, 15 Drawing Sheets

FIG. 1.
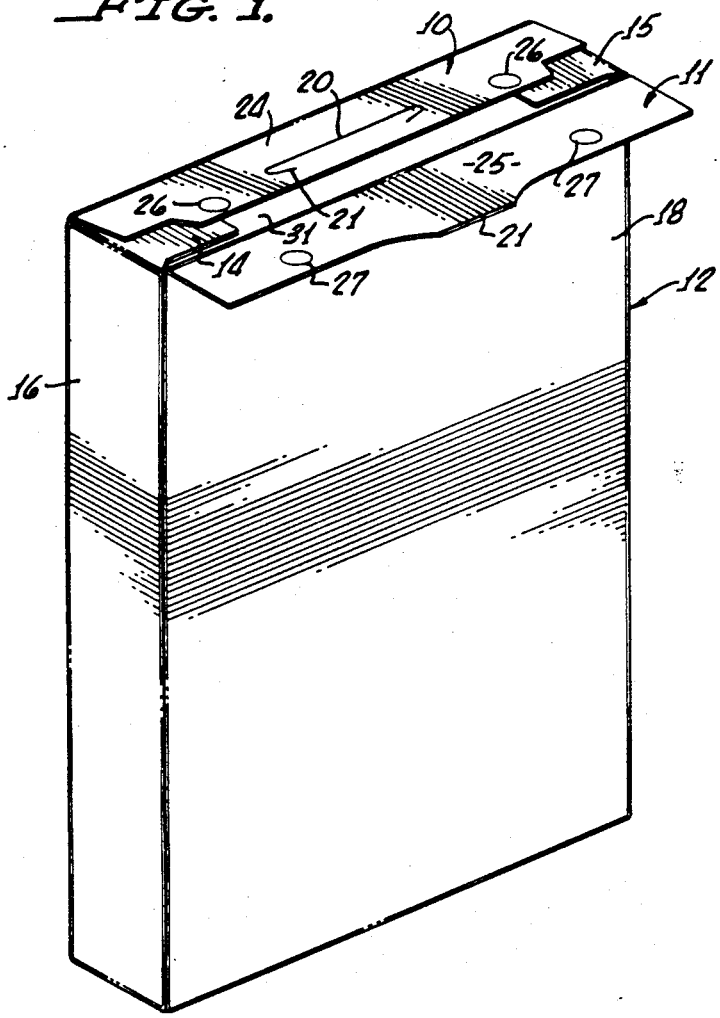
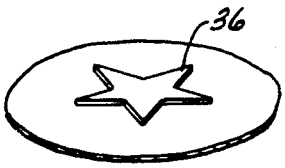
FIG. 7.
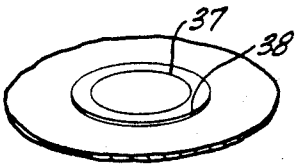
FIG. 8.
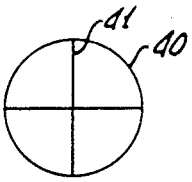
FIG. 9.
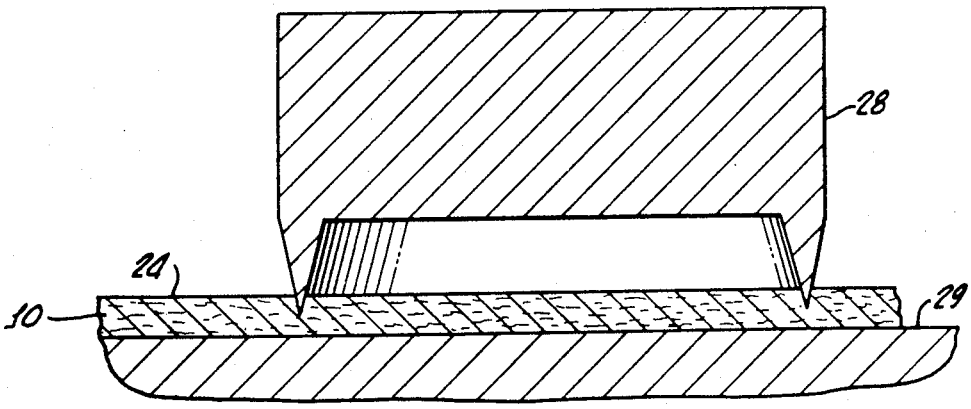
FIG. 3.

FIG. 10.
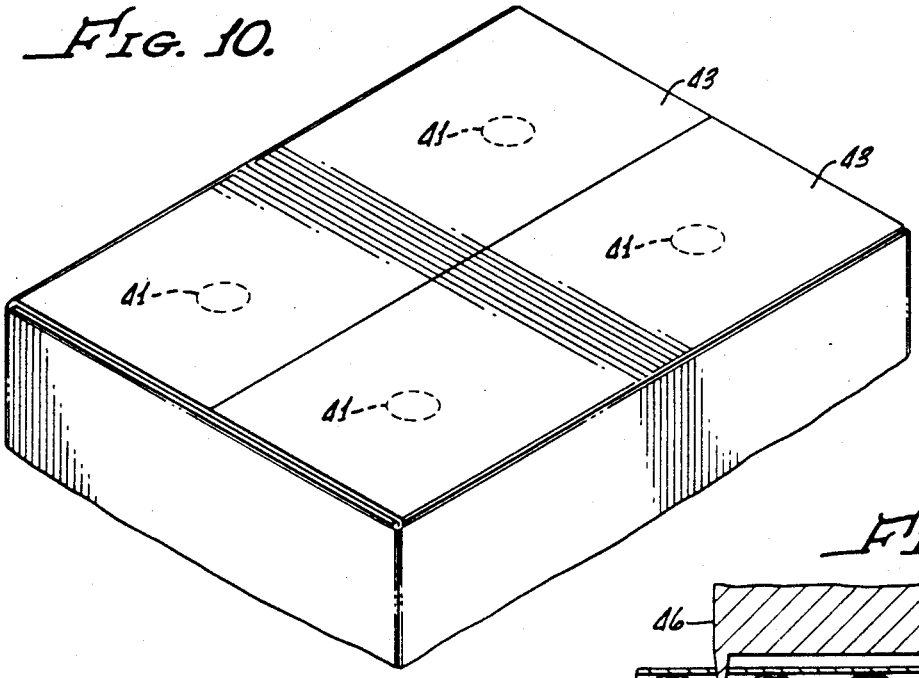
FIG. 13.
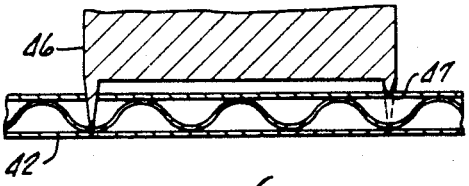
FIG. 11.
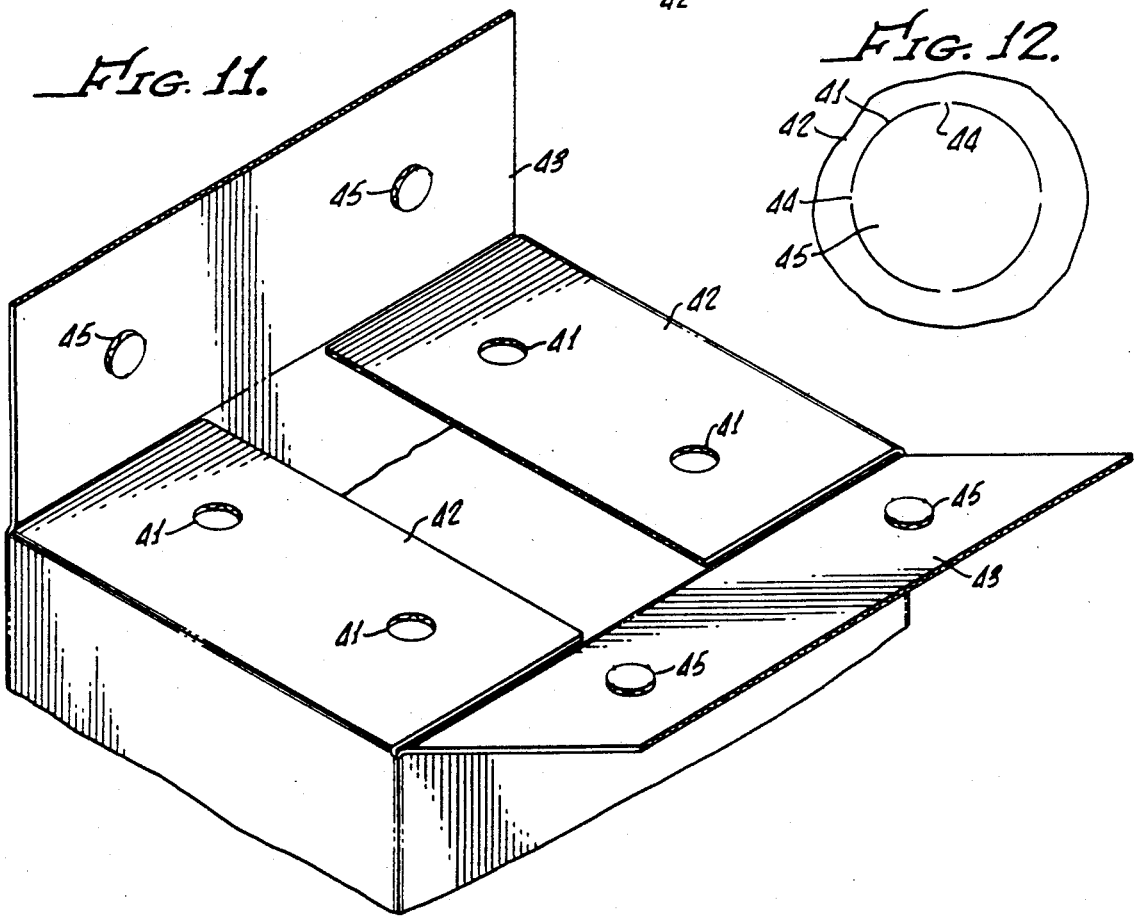
FIG. 12.

FIG. 20.
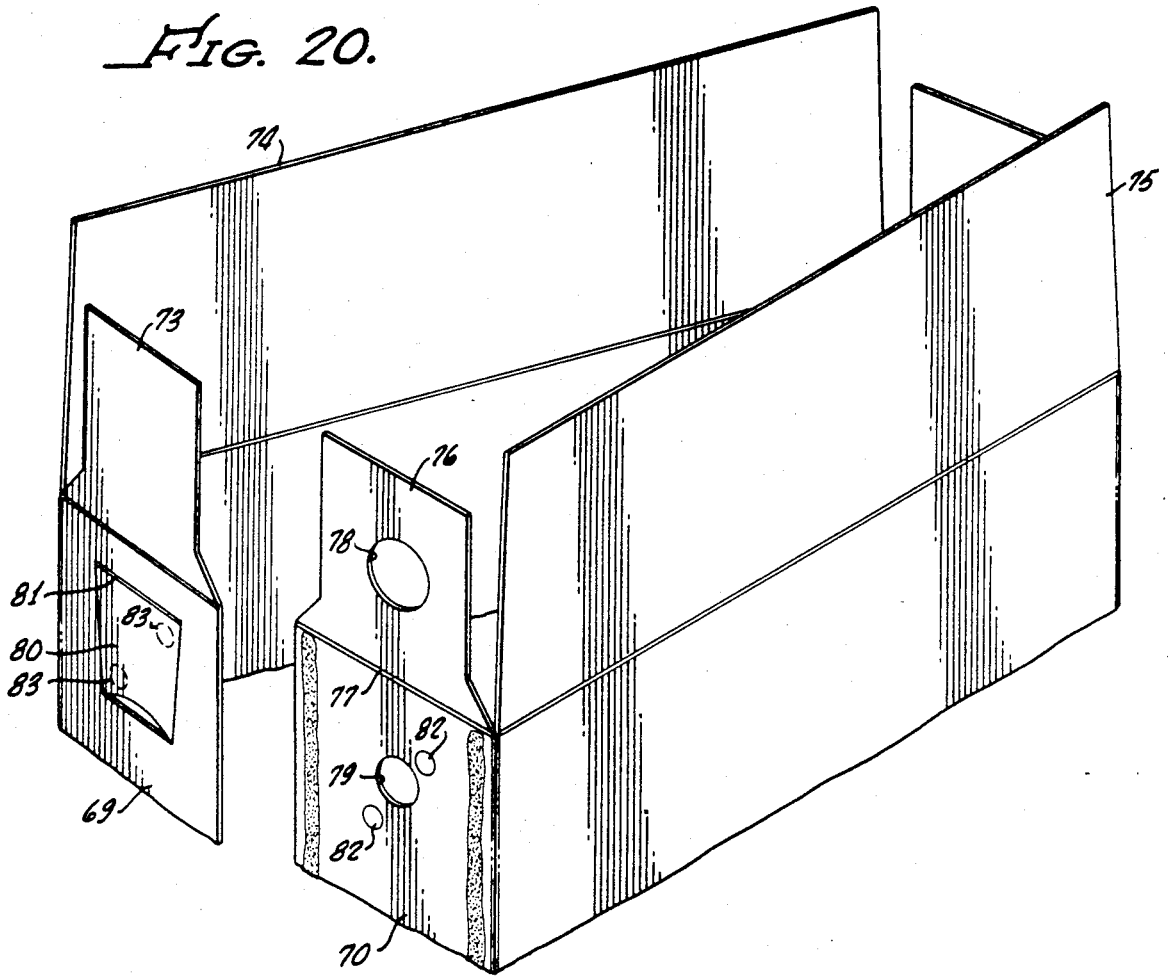
FIG. 21.
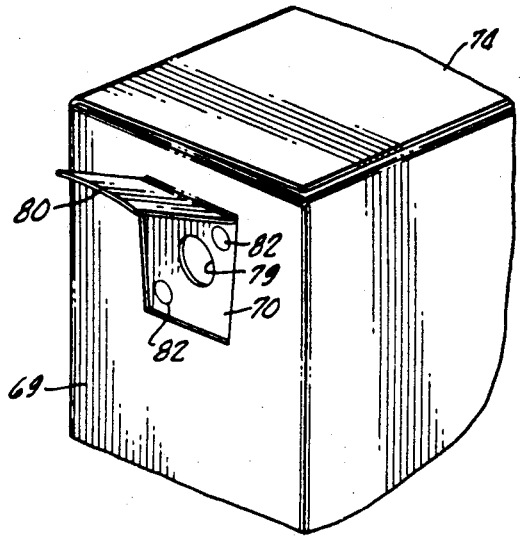
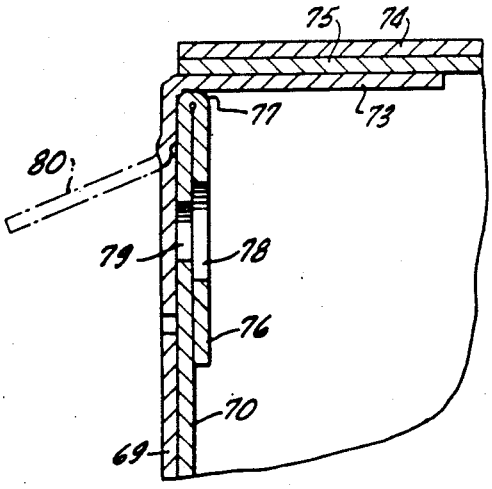
FIG. 22.

FIG. 23.
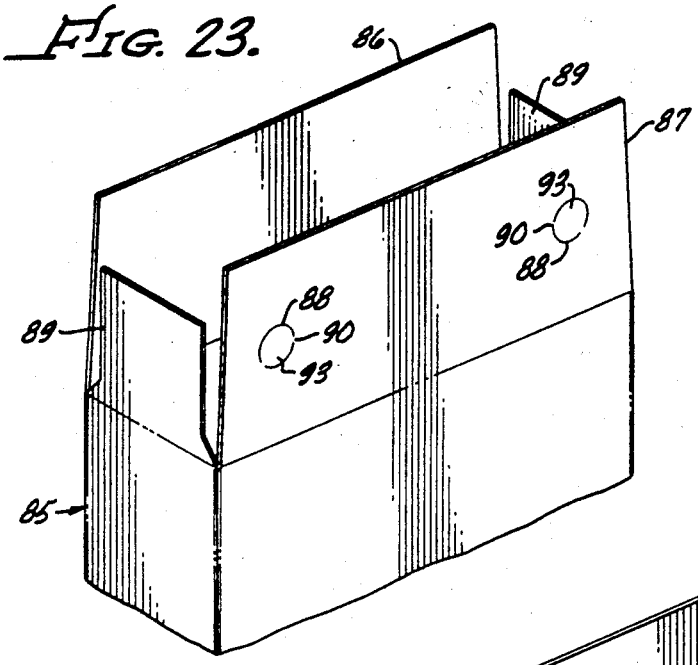
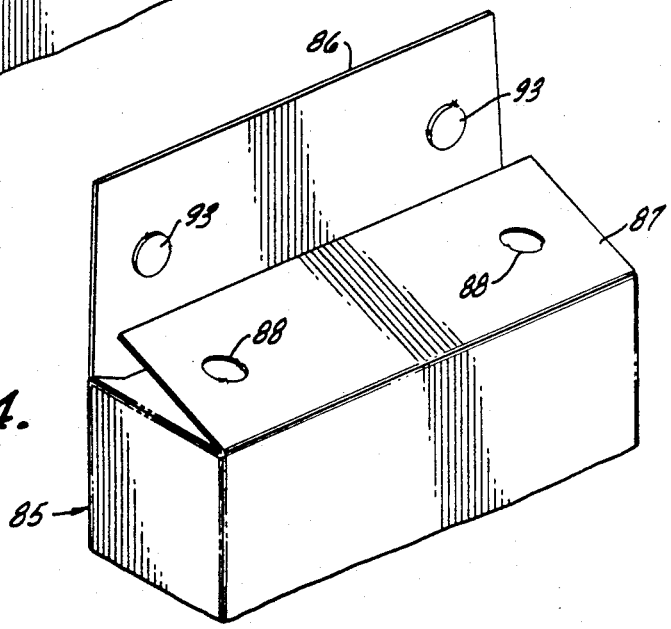
FIG. 24.
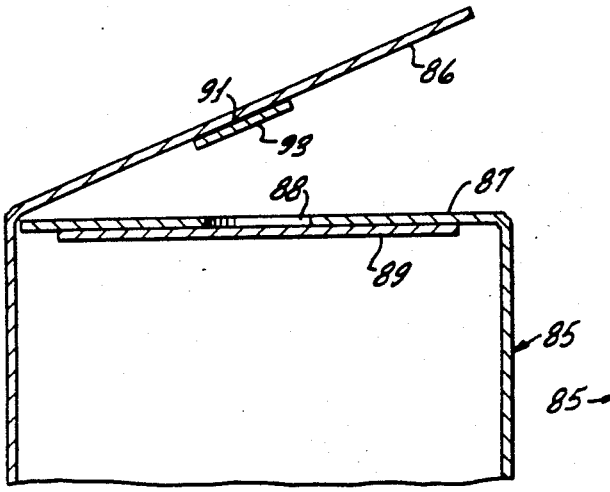
FIG. 25.
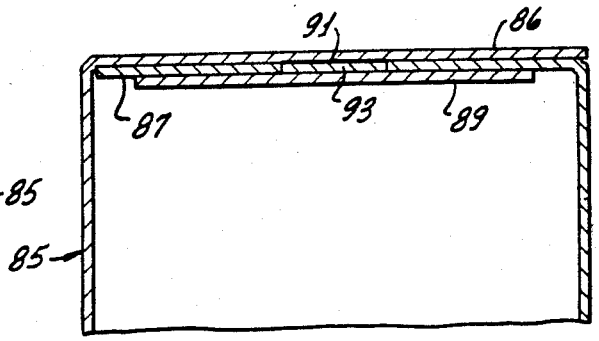
FIG. 26.

FIG. 27.
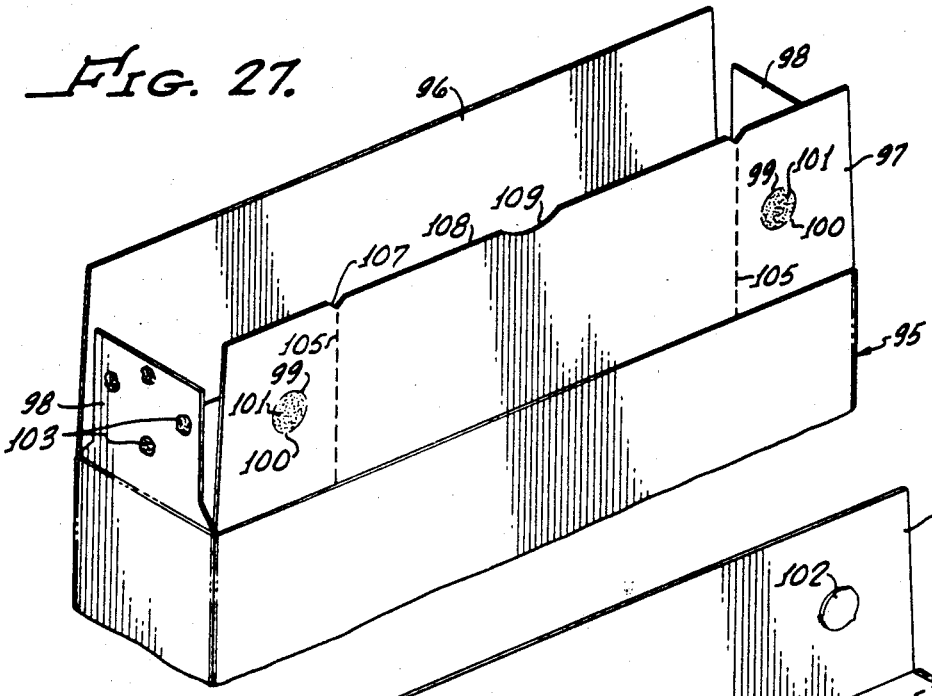
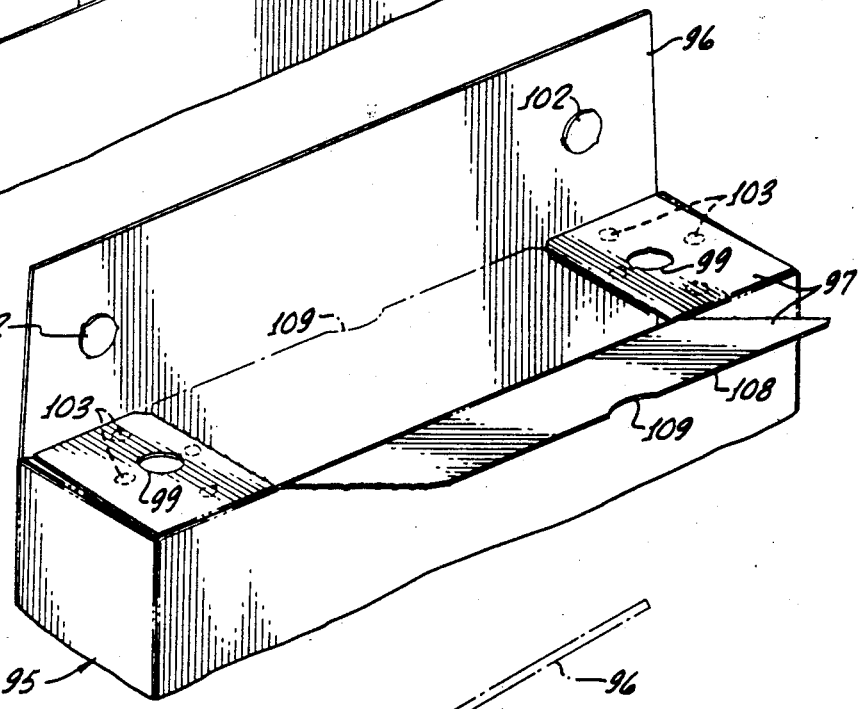
FIG. 28.
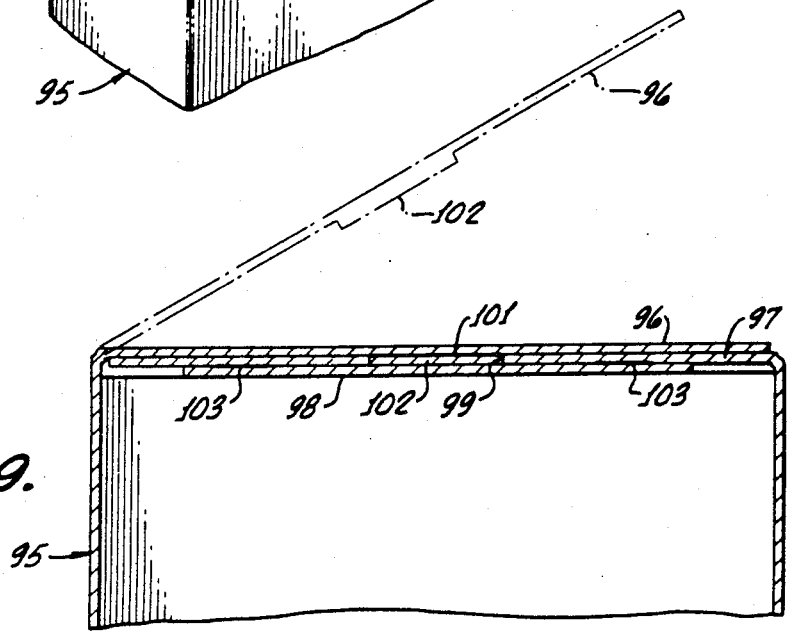
FIG. 29.

FIG. 36.
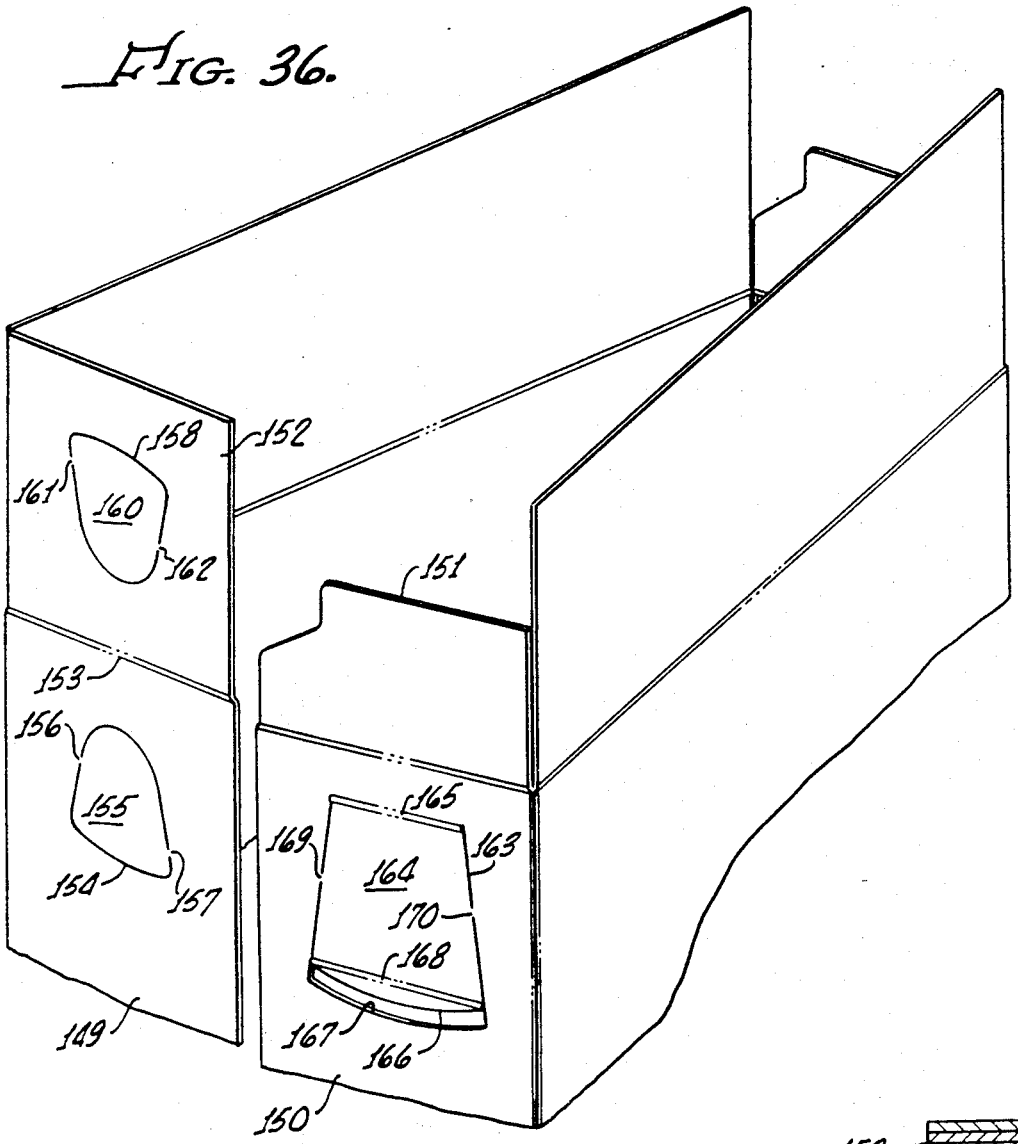
FIG. 37.
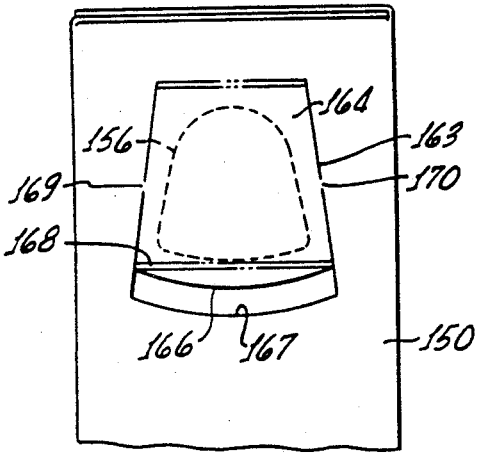
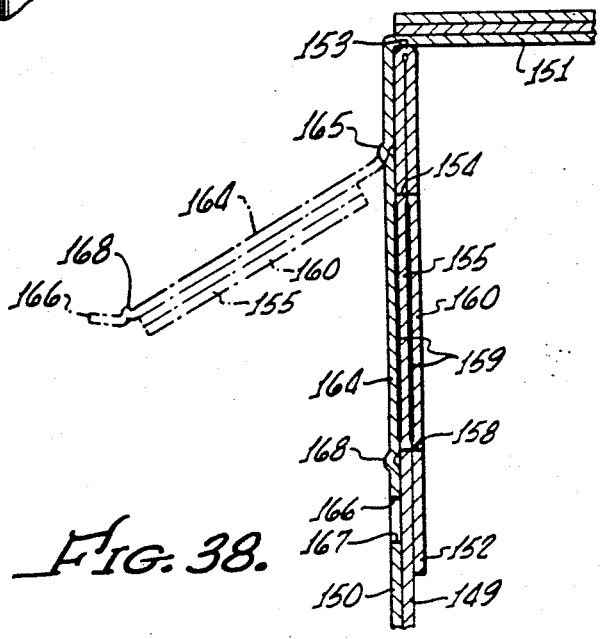
FIG. 38.

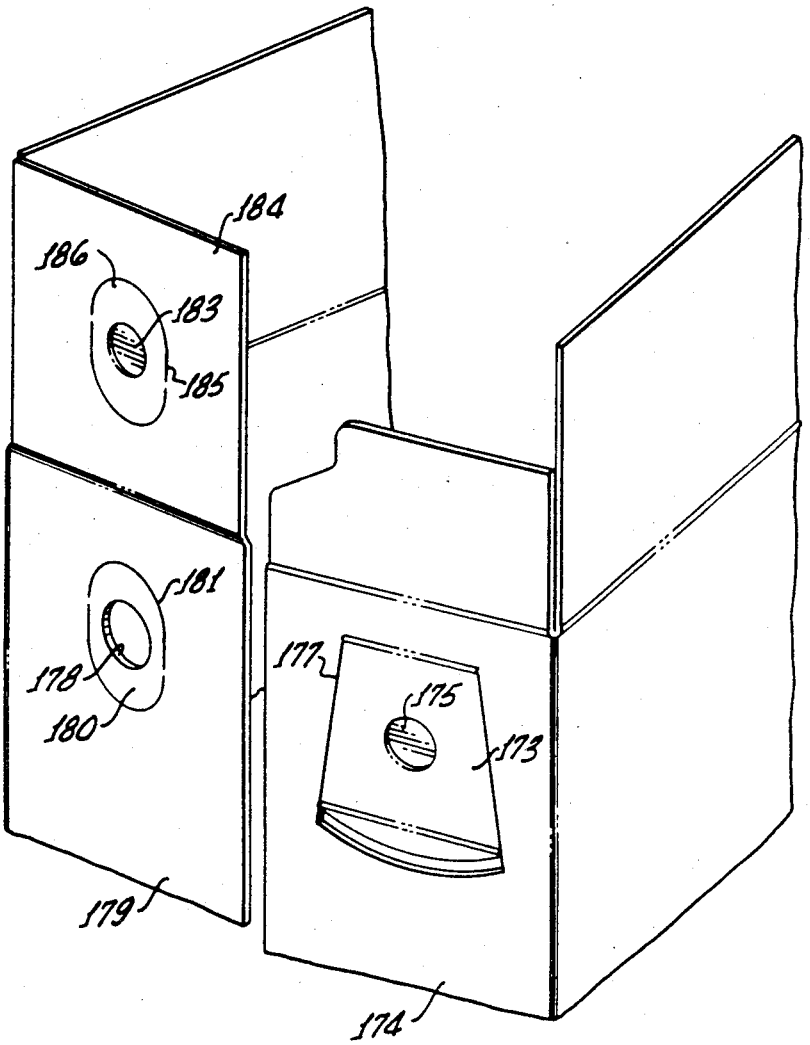
FIG. 41.
FIG. 39.
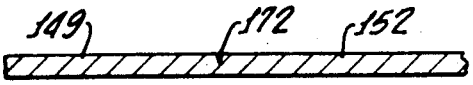
FIG. 40.
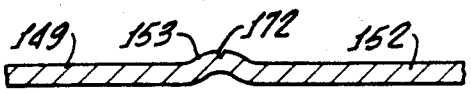
FIG. 42.
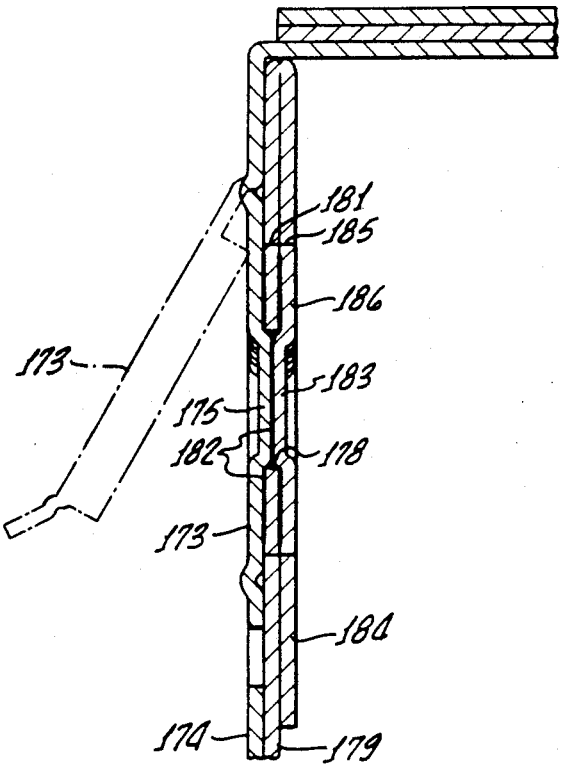

FIG. 43.
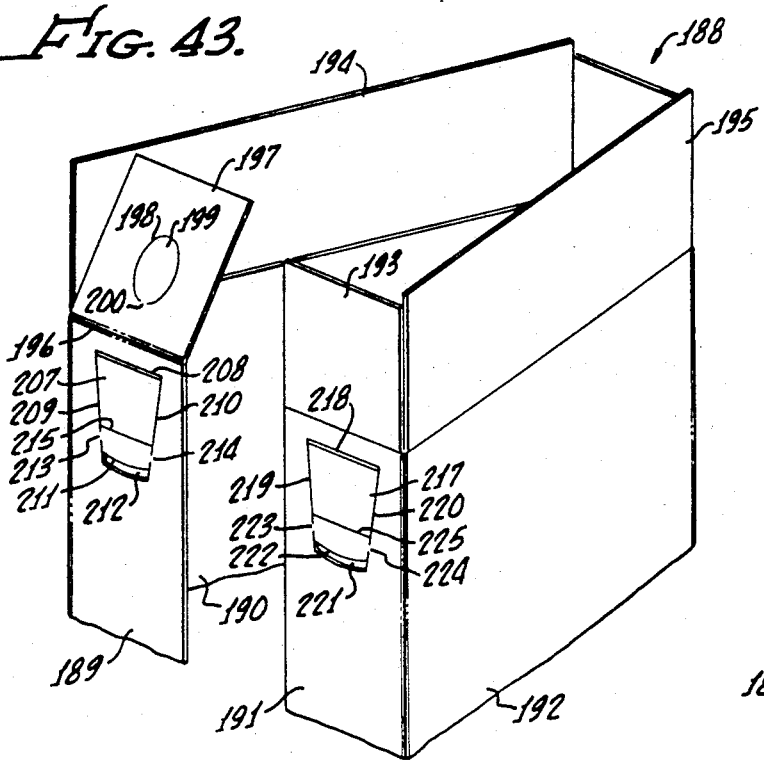
FIG. 44.
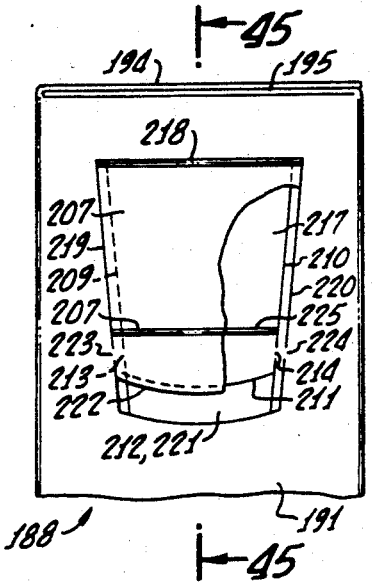
FIG. 45.
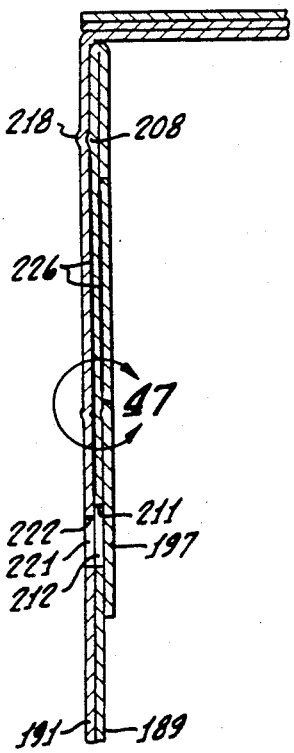
FIG. 46.
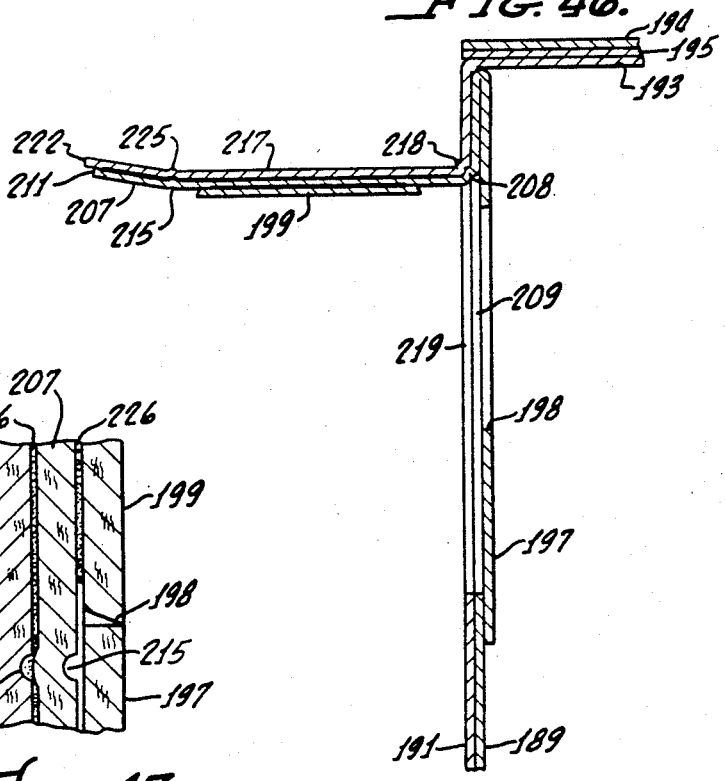
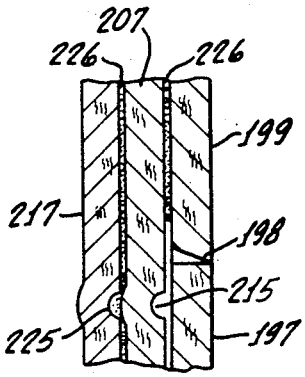
FIG. 47.

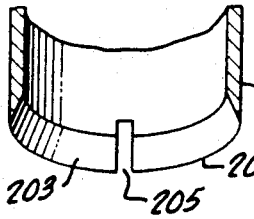
FIG. 48.
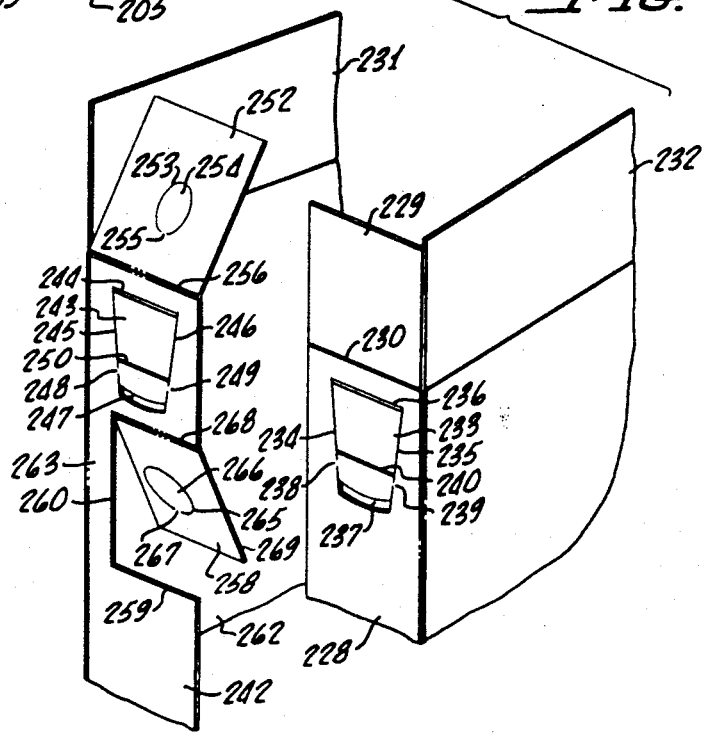
FIG. 52.
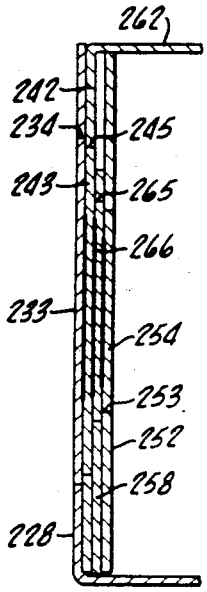
FIG. 55.
FIG. 53.
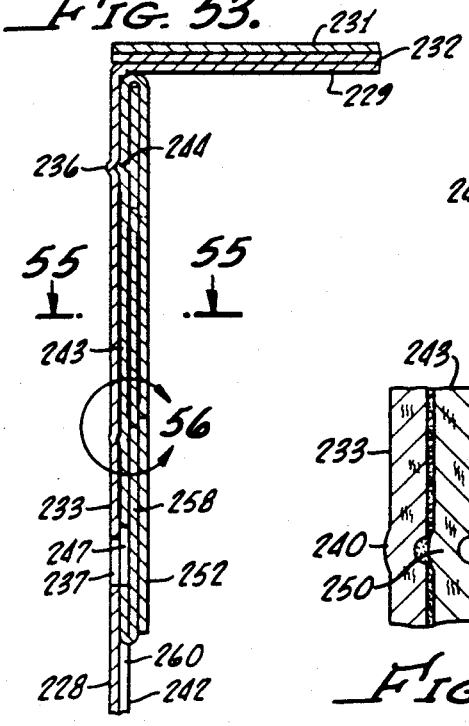
FIG. 54.
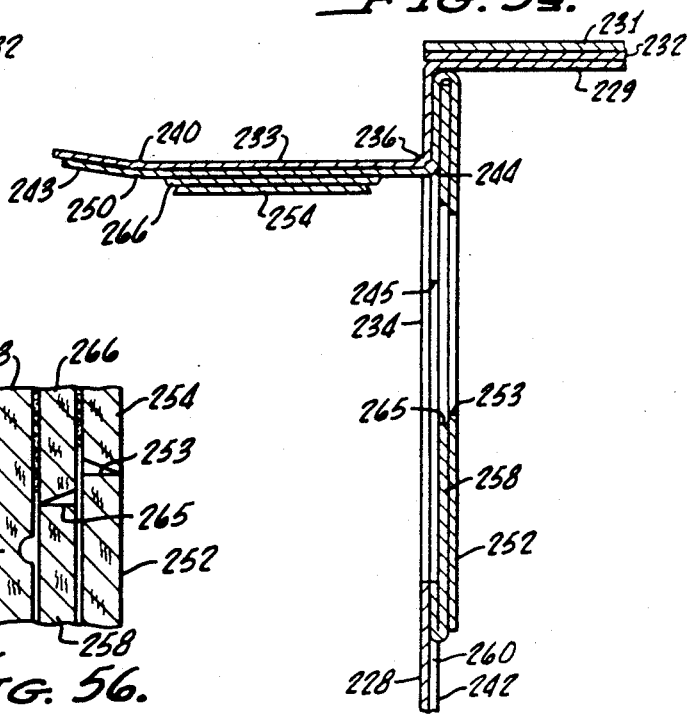
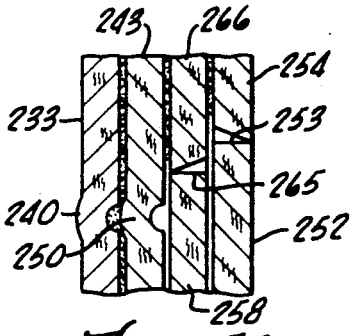
FIG. 56.

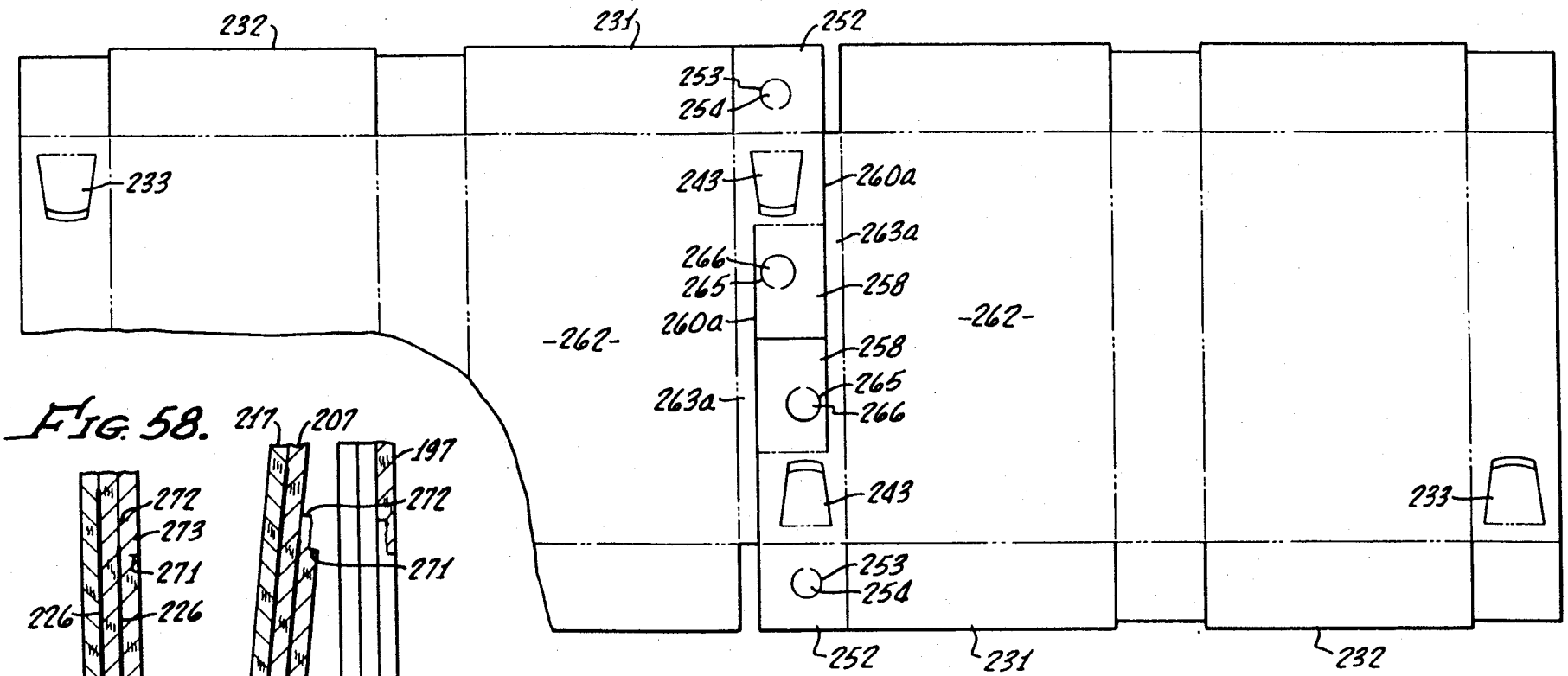
FIG. 57.
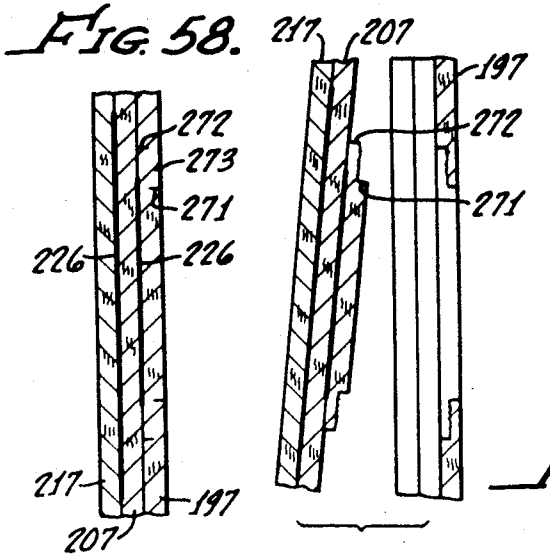
FIG. 58.
FIG. 59.

BOX GLUING ARRANGEMENT

CROSS-REFERENCE TO RELATED APPLICATION

This application is a continuation-in-part of application Ser. No. 163 692, filed Mar. 3, 1988 for Box Gluing Arrangement now abandoned, which in turn is a continuation-in-part of application Ser. No. 103,849, filed Oct. 1, 1987 now abandoned, for Box Gluing Arrangement. The disclosures of both of the prior applications are incorporated herein by this reference as though fully set forth.

BACKGROUND OF THE INVENTION

A long existent yet not fully achieved goal in the construction of paperboard and corrugated boxes is the ability to produce them economically, yet, at the same time, provide boxes that may be opened easily and that will provide a neat and attractive appearance after being opened. The type of box commonly used for crackers, cereals, and the like, is indicative of the difficulty in achieving ideal performance in box construction. This type of box has two overlapping flaps at its upper end, one having a projection to enter a slot in the other upon reclosure. Glue, such as hot melt glue, is provided in localized areas between the two flaps and is intended to permit the two flaps to be torn apart so that access can be gained to the interior of the box. When the box is closed and sealed by the manufacturer of the product it contains, the glue between the two flaps will squeeze in a haphazard and unpredictable fashion to various areas between the two flaps, rather than being confined at localized areas. Frequently, this results in a greater than intended glued area which makes the flaps difficult to separate. As the flaps are torn apart, the glue tears off portions of one of the flaps, providing hanging and projecting shreds of fibers which are untidy and unattractive in appearance. There are loose fibers which may fall into the contents of the box. Thus, although the box is relatively economical to manufacture, it is not readily opened nor does it provide an attractive appearance after opened.

Reclosure of the box is not always effective or convenient as the tab on one flap will not always remain in the slot in the other as the top flaps spring outwardly.

A special problem exists when the box contains granular material which is to be poured from the box through some form of opening. Frequently, a metal pouring spout is provided, but this is expensive to produce and attach to the box, also requiring an additional covering of paper or tape to assure that it does not open until the contents are to be removed. Sometimes a portion of the box is perforated to allow an opening to be formed by pressing inwardly and breaking the board at the location of the perforations, but this does not result in an opening that is well adapted to permit the contents to be poured out. Generally, it results in a flap at the location of the opening which gets in the way of the contents being poured out, and results in an uneven and difficult to control flow of material. This type of spout opening cannot be reclosed. Some products deteriorate upon exposure to the atmosphere, and the prior art spouts do not allow the box to be resealed once the spout has been opened.

Long narrow boxes which contain products such as aluminum foil, wax paper, and plastic wrap generally have a closure flap extending the length of the box which is to be loosened from the side of the box to allow the contents to be unrolled. In some instances, circular or oval cuts are made in the outer surface of the board making up the side of the box, these cuts extending only part way through the thickness of the board. Special ink then is printed over at least the areas between these cuts. When the box is sealed by the manufacturer of the product, a strip of liquid glue is applied to the closure flap or to a tear strip that extends along the side of the box. The glue is repelled by the special ink to the extent that it will not penetrate the fiber of the box in between the cut portions. However, when the tear strip or closure flap is to be loosened, the fiber can be torn away within the cuts to allow the separation. The result is a generally neat appearance upon opening the box, but this is achieved at the cost of greater manufacturing expense. Applying the special ink to repel the glue is a separate operation and, therefore, increases manufacturing costs.

SUMMARY OF THE INVENTION

The present invention provides an improved gluing technique for boxes which enables them to have secure closures which nevertheless are readily opened at the time of use and which provide a neat and tidy appearance when the box segments are torn apart. The boxes also may be effectively and easily reclosed. The cost of manufacturing the box is not increased and, in fact, savings in glue may be realized. The technique of this invention is applicable to a wide variety of boxes made of fibrous material, including those made of paperboard and those of corrugated paper.

In making a glue joint for box flaps in accordance with the present invention, cuts are made in the adjacent surfaces of overlapping flaps of the box which are to be secured together and later separated when the contents of the box are to be removed. The cuts in each surface extend part way, but not all the way, through the thickness of the board and define an enclosed or substantially enclosed pattern. The patterns of the overlapping flaps are in registry when the box is closed and to be glued. A drop of hot melt glue may be applied to one or the other of each matching pair of patterns prior to the time that the flaps are folded together. The glue may be applied in some other way, such as spraying, or it may be a pressure-sensitive, heat activated glue applied within both matching patterns. The cuts defining the patterns act as barriers, confining the glue so that it does not run beyond the borders of the patterns. Therefore, glue that tends to run is localized to predetermined areas. Only those areas will be secured after the gluing operation so that there are never any excessive glued portions to make it difficult to open the box.

When the flaps are torn apart, the fiber will tear away from within the patterns of one or the other of the flaps. The result is a neat, well-defined area having a regular and predetermined shape. In fact, decorative pattern shapes may be utilized, as well as such things as trademarks, letters or numbers. These will become visible as the flaps are torn apart. The inclusion of a cut in each flap gives virtually complete assurance that the fiber of the board will tear neatly from one flap or the other.

An effective pouring spout may be accomplished by providing a localized flap of material over a panel of the box which has a cut all the way through it to define an opening. The center part within the opening remains in place and is glued to the undersurface of the flap covering it. The center part is pulled completely away when the flap is pried outwardly, leaving a neat, well-defined opening through which the product may be poured. The center part of the opening again enters the opening in the panel when the flap is closed, retaining the flap in place by friction and resealing the contents.

The same technique also may be utilized for the overlapping closure flaps of a box. A cut is made through the inner flap with its center portion being glued to the undersurface of the outer flap. When the flaps are brought together again after having been separated, the center of the opening, which adheres to the outer flap, enters the opening to hold the flaps together by friction.

The gluing arrangement of this invention is used advantageously in the construction of boxes made of corrugated paper, enabling the box flaps to be attached securely yet separated without difficulty when the box is to be opened. No longer is it necessary to cut the box open, as has been the practice, which not only is time-consuming but often damaging to the contents of the box. This gluing arrangement will permit all of the flaps of the box to be separated, allowing the box to be flattened so that as refuse or for storage it occupies a minimum amount of space.

BRIEF DESCRIPTION OF THE DRAWINGS

FIG. 1 is a perspective view of a box constructed in accordance with this invention;

FIG. 3 is an enlarged sectional view showing the formation of a cut in one of the flaps;

FIG. 7 is a fragmentary perspective view illustrating the gluing arrangement as utilized to provide a glue pattern of a special form;

FIG. 8 is a view similar to FIG. 7 showing a different form for the glue pattern;

FIG. 9 is a plan view of a glue pattern having separable segments;

FIG. 10 is a fragmentary perspective view of a box of corrugated paper glued at its closure flaps in accordance with this invention;

FIG. 11 is a fragmentary perspective view of the box of FIG. 10 with the flaps separated;

FIG. 12 is an enlarged fragmentary plan view of the cut made in the flaps of the box of FIGS. 11 and 12;

FIG. 13 is a fragmentary sectional view showing the cutting of the corrugated paper preparatory to forming a glue joint;

FIG. 20 is an exploded fragmentary perspective view of a box having a different form of pouring spout;

FIG. 21 is a fragmentary perspective view of the box of FIG. 20 with the spout open;

FIG. 22 is a fragmentary sectional view illustrating the construction of the spout;

FIG. 23 is a fragmentary perspective view illustrating a closure arrangement for the top flaps of a box, with the flaps separated;

FIG. 24 is a fragmentary perspective view of the box of FIG. 23 after the flaps have been closed and then separated;

FIG. 25 is a fragmentary sectional view showing the box of FIGS. 23 and 24 with the top flap opened;

FIG. 26 is a view similar to FIG. 25 with the top flap closed;

FIG. 27 is a fragmentary perspective view of a different form of box closure;

FIG. 28 is a view similar to FIG. 27, but with the top flaps open;

FIG. 29 is an enlarged transverse sectional view of the box of FIGS. 27 and 28, illustrating the glue joint;

FIG. 36 is an exploded fragmentary perspective view of a box having another form of pouring spout;

FIG. 37 is a fragmentary end elevational view of the box of FIG. 36 as completed;

FIG. 38 is a fragmentary sectional view taken along line 38—38 of FIG. 37;

FIG. 39 is a fragmentary sectional view of the board with a partial cut in preparation for making a bend;

FIG. 40 is a view similar to FIG. 39 illustrating a score formed over the cut;

FIG. 41 is an exploded fragmentary perspective view of a box having a modified pouring spout arrangement;

FIG. 42 is a fragmentary enlarged sectional view of the spout arrangement of FIG. 41;

FIG. 43 is a fragmentary perspective view of a modified form of a box, partially assembled, which provides a double thickness for the closure flap;

FIG. 44 is an enlarged fragmentary elevational view of the end panel of the box of FIG. 43;

FIG. 45 is a longitudinal sectional view taken along line 45—45 of FIG. 43;

FIG. 46 is a view similar to FIG. 45 but with the spout in the open position;

FIG. 47 is an enlarged fragmentary sectional view taken at line 47 in FIG. 45;

FIG. 48 is a fragmentary perspective view of the punch for providing the cut for the spout opening;

FIG. 52 is a fragmentary perspective view of the box in partial assembly;

FIG. 53 is a longitudinal sectional view taken along line 53—53 of FIG. 49;

FIG. 54 is a view similar to FIG. 53 but with the spout in the open position;

FIG. 55 is a transverse sectional view taken along line 55—55 of FIG. 53;

FIG. 56 is an enlarged fragmentary sectional view taken at line 56 of FIG. 53;

FIG. 57 is a plan view of a modified flat pattern arrangement which minimizes the amount of board used.

FIG. 58 is a fragmentary sectional view of a spout that provides a waterproof closure; and FIG. 59 is a view similar to FIG. 58 with the spout opened.

DETAILED DESCRIPTION OF THE INVENTION

Figure 2:
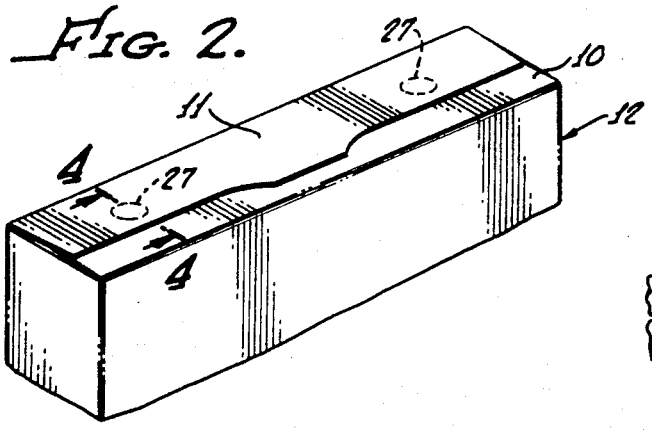
FIG. 2 is a fragmentary perspective view of the box of FIG. 1 with the flaps in the closed position.

As illustrated in FIGS. 1-5, the gluing arrangement of this invention is utilized in providing the closure for the upper flaps 10 and 11 of a box 12. Other than the arrangement for gluing the flaps 10 and 11, the box 12 is conventional. Thus, at its upper end there is an opening 13 over the edge portions of which are bent dust flaps 14 and 15 which are integral with the relatively narrow side panels 16 of the box. The flaps 10 and 11 are integral with the wider front and back panels 18 and overlap the dust flaps 14 and 15. The flap 10, which is beneath the flap 11 in the completed and glued box, is provided with a cut 20 which is straight and includes short end parts which are doubled back relative to the main portion of the cut. This cut is to receive a projection 22 from the flap 11 in reclosing the box after it has been opened.

A box of the type shown in FIGS. 1-5 normally will be made of cardboard having one white clay-coated surface and a gray opposite surface which is uncoated. In the completed box the coated surface is on the outside and is printed with the identification of the contents and with other information. Consequently, the outer surface 24 of the flap 10 is finished, and the inner surface 25 of flap 11 is gray and unfinished.

In the manufacture of the box 10 a sheet of board is run though a press where various cuts and scores are made to enable the sheet to be folded and assembled into the box enclosure as shown in FIGS. 1 and 2. During this time, special cuts are made in flaps 10 and 11 for use in the gluing operation. In the example shown, these are circular cuts. Two of the cuts 26 are formed in what becomes the outer finished surface 24 of the flap 10 in the completed box. The other two circular cuts 27 are made in the portion that becomes the gray unfinished undersurface 25 of the flap 11. The cuts 26 and 27 are positioned such that when the flaps 10 and 11 are bent across the opening 13 in closing the box, each of the cuts 27 is superimposed on and registers with one of the cuts 26.

The cuts 26 and 27 extend only part way through the board that makes up the box. Preferably, in order to preserve the strength of the board, the cuts do not extend more than half way through the thickness of the board. These cuts may be formed by a conventional circular punch 28, as shown in FIG. 3, while the board is supported by the bed 29 of the press as the board is prepared for formation into the box shape.

A small quantity of glue 30 is introduced between the flaps at the locations within the superimposed cuts 26 and 27. This may be a hot melt glue applied to one flap or the other before the flaps 10 and 11 are folded together. Also suitable, for example, is contact cement applied to both flaps and activated by heat when the flaps are to be attached together. In either case, as the flap 11 is folded over the flap 10, the box becomes secured together by the glue between the superimposed areas at the cuts 26 and 27. The cuts 26 and 27 act as barriers that confine the glue so that it will not run between the flaps 10 and 11 beyond the confines of the cuts 26 and 27. This is of particular importance when a hot melt glue is used.

Figure 5:
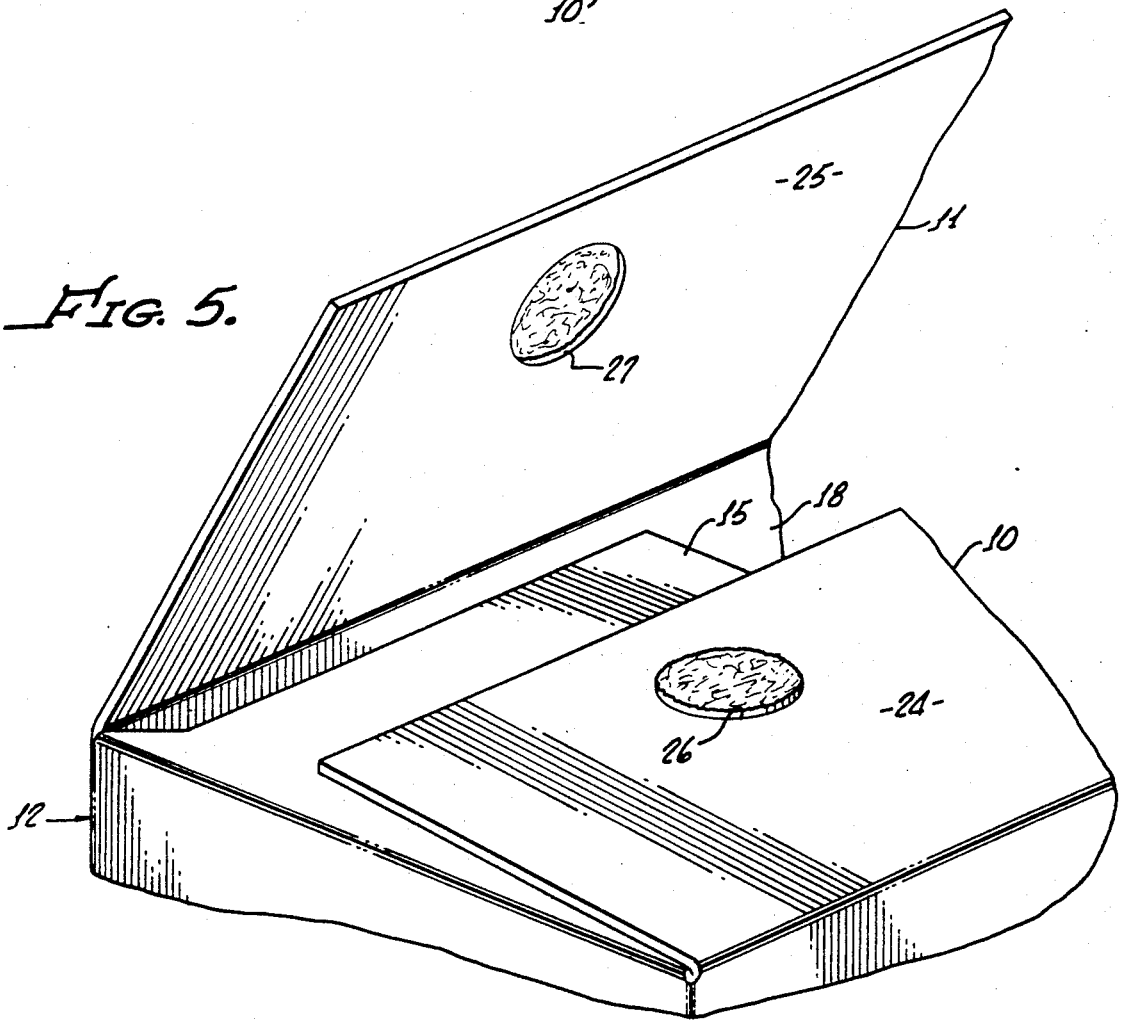
FIG. 5 is an enlarged fragmentary perspective view showing one flap of the box separated from the other.
Figure 14:
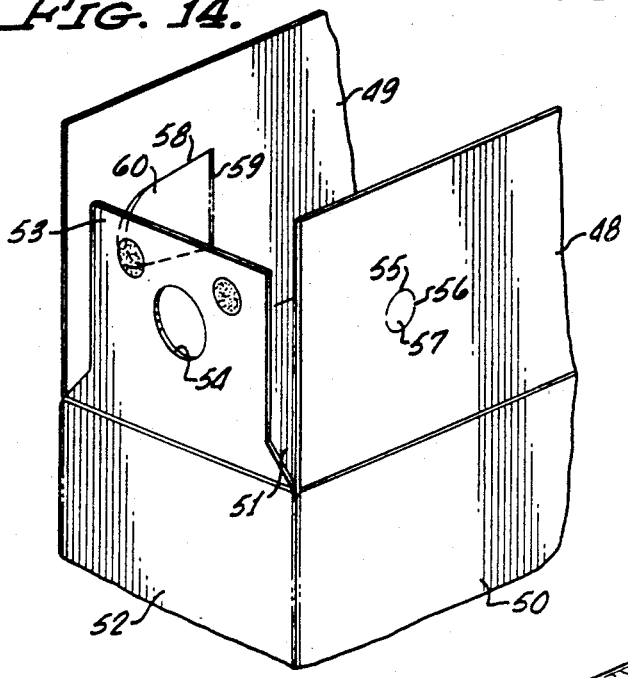
FIG. 14 is a fragmentary perspective view of a box having provision for a pouring spout, prior to securing the flaps.
Figure 18:
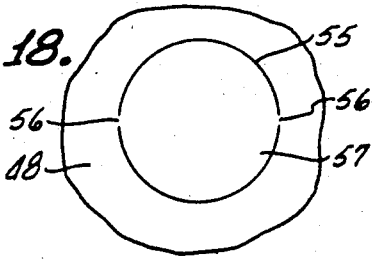
FIG. 18 is a plan view showing the type of cut made in one of the flaps that provides the spout.

The flaps 10 and 11 are opened by inserting a finger under the protrusion 22 of the flap 11 and pulling upwardly in the manner customary for boxes of this type. As this is done, the glued joints separate at the cuts 26 and 27 where the fiber will be pulled away from one flap and retained by the other. Normally, the fiber will be pulled away from the area receiving the glue when the glue has been applied only to one flap. For example, as shown in FIG. 5, the fiber of the board making up the box may be pulled away from the area within the cuts 27 of the flap 11 and retained above the cuts 26 of the flap 10. The result is a very neat tear, providing a regular appearance with no unsightly raggedness. There are no loose shreds or fibers to possibly fall into the interior of the box. Moreover, because the glue is confined to areas of predetermined dimensions, the force necessary to separate the flaps may be controlled accurately. This is done by varying the sizes and numbers of the cuts for the glue joints. This means that the box can be made so that it can be opened more easily than those of conventional design. Nevertheless, the strength of the glued joint is not sacrificed.

Figure 6:
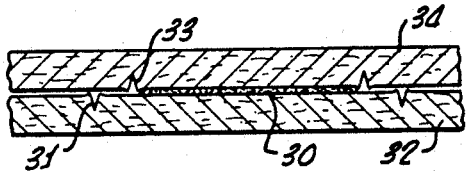
FIG. 6 is a fragmentary sectional view illustrating a modification of the gluing arrangement.
Figure 4:
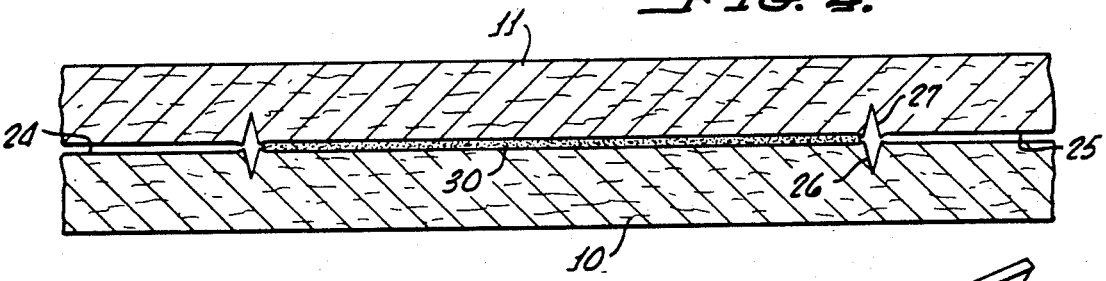
FIG. 4 is an enlarged fragmentary sectional view of a glue joint, taken along line 4—4 of FIG. 2.

As shown in FIGS. 1-5, the cuts 26 and 27, which are in registry when the box is glued, are of the same diameter. However, in some instances it is preferred that the cut on one side of the glued joint has a larger lateral dimension than that on the other. For example, as shown in FIG. 6, the cut 31 formed in one flap 32 of the two overlapping flaps is of greater diameter than the cut 33 in the other flap 34.

The partial cuts provided in the board for the gluing joint need not be circular, but may be almost any shape. An example is shown in FIG. 7 where the cut 36 has the shape of a star that matches another star cut (not shown) as the glue joint is formed. This means that upon opening the flaps of the box the shape of a star, rather than a circle, will appear at the separated areas.

In FIG. 8, cuts 37 and 38 provide one circle within another. Other shapes, such as trademarks or letters, may be utilized. Thus, the glue areas may be used to provide an interesting appearance or to convey some message upon the opening of the box.

In some instances, especially when hot melt glue is applied, the gluing machinery may not apply the glue precisely at the center of the cut pattern. In order to assure a neat tear when the box is opened, irrespective of an off-center application of glue, additional cuts may be made internally of the pattern. For example, as shown in FIG. 9, there is a circular cut 39 with a cruciform cut 40 within it, dividing the pattern into four internal segments. In the event that the glue should be offset so that the entire space within the cut 39 will not adhere to the opposing flap, &hen those portions receiving the glue will tear off neatly without leaving a ragged edge. For example, three of the segments may receive glue and tear away when the box is opened, leaving the fourth intact and in place. The portion torn away will be along precise lines and will not be unattractive in appearance.

For boxes of corrugated paper, as shown in FIGS. 10–13, it is preferred to provide enclosed cuts 41 only in the inner flaps 42 which are covered by the outer flaps 43 in the completed box. The cuts 41, which are circular in the example shown, extend all the way through the flap 42, except for being interrupted by small uncut segments 44. These segments connect the center part 45 within each cut 41 to the remainder of the flap 42 outside of the cut. In the example of FIG. 12, there are four uncut segments 44 for each cut 41.

The cuts 41 may be created by a punch 46, as seen in FIG. 13, which has notches 47 in its blade at the locations where the uncut segments 44 are to remain.

Glue is applied between the center parts 45 and the adjacent undersurfaces of the outer flaps 43. This provides glue joints that securely hold the flaps 42 and 43 together, inasmuch as the center parts 45 are connected to the remainder of those flaps by the uncut segments 44. Nevertheless, to open the box, the outer flaps 43 can be pulled away from the inner flaps 42, as seen in FIG. 11. This tears apart the uncut segments 44 and allows the center parts 45 to be removed from the cuts 41 as they adhere to the outer flaps 43. The strength of the connections between the flaps 42 and 43 may be controlled by varying the number and sizes of the cuts 41 and the uncut segments 44.

This arrangement provides much easier access to the interior of the box than with a conventional corrugated paper box. The storekeeper no longer will be required to cut the boxes open, possibly damaging the contents in the process. Moreover, empty boxes may be easily separated at the flaps and then flattened for compact storage. This reduces the requirements for refuse areas at stores or alternatively permits reuse of the boxes.

An effective pouring spout, such as for granular material, may be provided very economically through the gluing arrangement of this invention. As shown in FIGS. 14–18, two overlapping flaps 48 project from the front and back panels 50 and 51 of the box at the top of the box where the spout is located. At one edge, projecting from the side panel 52 of the box, is a dust flap 53 that fits beneath the two closure flaps 48 and 49. A relatively large opening 54 is formed in the dust flap 53 and stripped clear. The flap 48, which is underneath the flap 49 in the completed box, is provided with a circular cut 55 entirely through the board, except for two very small uncut segments 56 which interrupt the cut 55 at two opposite locations. More than two such uncut segments may be provided for. Hence, the center part 57 within the cut 55 remains in place as the box is assembled. The diameter of the cut 55 is no greater than that of the opening 54, and in the embodiment shown it is smaller.

The other flap 49 includes a cut 58 which has two straight side edges tapering toward the end of the flap, connected at one end by a convexly curved part. The lateral dimension of the cut 58 is somewhat larger than the diameter of the cut 55 in the flap 48. The cut 58 extends all the way through the board making up the flap 49. At the inner end of the cut 58, parallel to the intersection of the dust flap 53 with the side panel 52, is a score 59 to permit bending. The result is a small flap 60 hinged at the score 59. An additional cut 61 is made through the flap 60 adjacent the curved end of the cut 58, opposite from the score 59, providing a small open area at the end of the flap 60.

When the box is assembled, the dust flap 53 is glued to the undersurface of the flap 48, and the flaps 48 and 49 are glued together in a conventional manner. The centers of the cuts 54 and 55 then are in registry and are covered by the flap 60. A small quantity of glue 63 is introduced between the center part 57 of the cut 55 and the adjacent undersurface of the flap 60 at the time the assembly is made. This may be a contact cement that can be positioned very accurately on the board, applied both to the center part 57 and in a circular pattern on the underside of the flap 60. Also, a drop of glue, such as hot melt glue, about one half the diameter of the cut 55, may be used.

When the spout is to be opened, the flap 60 is lifted and pivoted about the score 59 by prying upwardly at its curved end. Access to the end of the flap 60 is provided by the open area at the cut 61. As this is done, the center part 57 within the cut 55 is pulled out entirely, readily tearing away at the small frangible interconnecting segments 56, adhering to the undersurface of the flap 60. Consequently, a full die-cut round opening is provided, allowing the contents of the box to be poured out as desired.

After this, the flap 60 may be returned to its original position, covering the opening at the cut 55 so that the pouring spout is closed. When this is done, the circular part 57 pulled out of the center of the cut 55 is returned to its original location where, by friction, it will hold the flap 60 closed. The frictional effect is enhanced by the tufts remaining when the uncut segments 56 are torn apart upon opening the flap 60. The flap 60 not only is held closed in this manner, but also seals the spout opening when the center part 57 enters the opening. The three thicknesses of board—top flaps 48 and 49, and dust flap 53—at the location of the spout assure adequate strength and stability.

Figure 19:
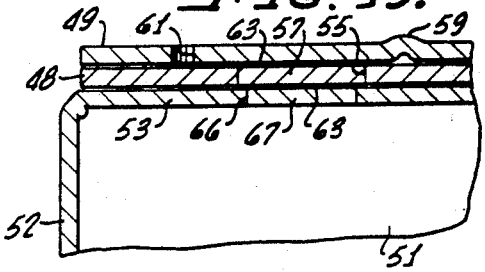
FIG. 19 is an enlarged fragmentary sectional view similar to FIG. 16 but showing a modified arrangement for the pouring spout.
Figure 15:
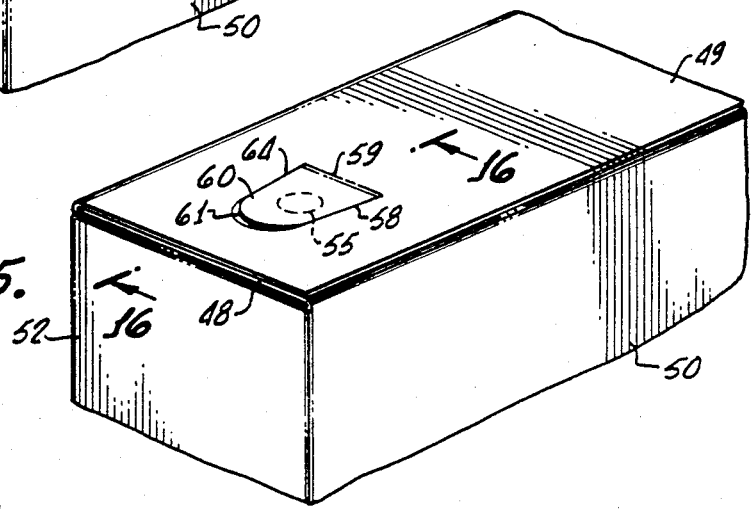
FIG. 15 is a view similar to FIG. 14 but with the flaps closed.
Figure 17:
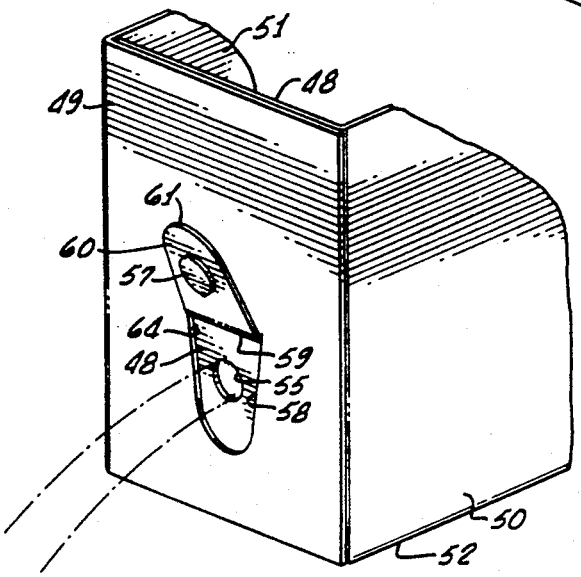
FIG. 17 is a fragmentary perspective view illustrating the use of the spout.
Figure 16:
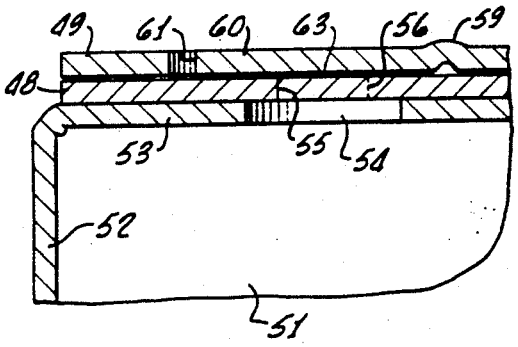
FIG. 16 is an enlarged sectional view taken along line 16—16 of FIG. 15.

In the version of FIG. 19, the opening 54 in the dust flap 53 is replaced by a cut 66 which resembles the cut 55 in the flap 48. Thus, the cut 66 extends all the way through the dust flap 53, except for small frangible interconnecting segments, and the center part 67 within the cut remains in place when the box is assembled. Glue 63 secures the center part 67 of the dust flap 53 to the center part 57 within the cut 55 of the flap 48. The cut 66 has a diameter no greater than that of the cut 55. When the flap 60 is opened, the interconnecting segments are broken and the center part 67 is stripped out of the cut 66, as well as the center part 57 that is within the cut 55, because of the glued connections. An even greater retention of the flap 60 is accomplished when that flap is closed, because of the friction created by the two center parts 57 and 67 as they enter the cuts 55 and 66. The sealing effect also is enhanced upon reclosure. The retention of the flap 60 and the sealing effect are maximized by making the cuts 55 and 66 substantially the same size.

The spout may be formed in the side panel of the box as well as its top, as illustrated in FIGS. 20–22. The side panel where the spout is located is made up of two overlapping panels 69 and 70 which extend from the front and back panels 71 and 72, and are glued together. A short dust flap 73 projects from the upper edge of the outer panel 69, fitting beneath the top panels 74 and 75 of the completed box. A flap 76, resembling the dust flap 73 in shape, projects from the top of the panel 70.

The board is scored at the connection 77 between the panel 70 and flap 76 so that the flap 76 can be bent downwardly to overlap the inside of the upper end of the panel 70, as seen in FIG. 21. The flap 76 is glued to the inner surface of the flap 70.

A relatively large opening 78 in the flap 76 is aligned with a smaller opening 79 in the panel 70, in the example given. Covering these openings is a closure flap 80 formed in the outer side panel 69. The flap 80 is hinged at its top about a horizontal score 81 and cut through along its side and bottom edges. Two circular cuts 82 partially through the panel 70 on diametrically opposite sides of the opening 79 match similar cuts 83 in the undersurface of the flap 80. Glue is applied between these cuts, which are superimposed, to hold the flap 80 firmly over the opening 79. Nevertheless, the flap 80 can be readily and neatly torn away from these glued connections to be lifted upwardly for allowing the contents of the box to be poured through the openings 78 and 79. Again there is a triple thickness of board at the spout which imparts strength and stability to the box.

The openings in the side panel spout may retain their centers until the spout is opened by lifting the flap, if desired, in the same manner as the embodiments of FIGS. 14–19. Similarly, the spouts in the top of the box may be made with the openings stripped clear as the box is manufactured. In any event, when the openings are stripped clear, the frictional retention of the outer closure flap and sealing of the spout opening are lost.

In any of the spout constructions there may be only two thicknesses of board provided, omitting the innermost layer at the spout, if preferred.

The spouts may be formed of paperboard or corrugated material with equal success.

The box arrangement of FIGS. 23–26 provides for reclosure of the top flaps in a manner similar to that of FIGS. 14–19 for the flap that closes the spout opening. The box 85 is provided with top flaps 86 and 87 which provide access to the interior of the box. The flap 87 is underneath and overlapped by the flap 86 in the assembled box. Two circular cuts 88 are provided in the flap 87 adjacent its ends and in locations where they are above the dust flaps 89 when the box is closed. The cuts 88 are interrupted by small, uncut frangible segments 90 that connect the part within the cuts and the remainder of the flap. A quantity of glue 91 is applied between the parts 93 of the flap 87 within each of the cuts 88 and the adjacent portions of the undersurface of the flap 86. Consequently, the flap 86 adheres to the flap 87.

Upon opening the flaps, the board within the cuts 88 is stripped out of the openings, leaving circular segments 93 adhering to the undersurface of the flap 86. Upon reclosure of the flaps 86 and 87, the portions 93 re-enter the openings at the cuts 88 to provide a frictional retention for the outer flap 86. Again, as with the spout closures, the tufts remaining where the frangible interconnecting segments 90 have been torn apart add to the frictional effect of the reattachment of the flap 86 to the flap 87.

Particularly for larger boxes, it may be desirable to provide a support at the locations of the openings where the segments have been removed from the lower panel. This construction is shown in FIGS. 27–29. Here, the box 95 includes a closure flap 96 at its top which overlaps a flap 97 opposite from it. Dust flaps 98 fit beneath the flap 97. As before, circular cuts 99 are formed in the under flap 97 and interrupted by uncut frangible segments 100. Glue 101 is applied between the parts 102 of the flap 97 within the cuts 99 and the undersurface of the flap 96. In this arrangement the flap 97 is glued to the two dust flaps 98, such as by quantities of glue 103 which are positioned so that they are spaced from the cuts 99 when the flap 97 overlaps the dust flaps 98.

In addition, the flap 97 is provided with a transverse perforation 105 spaced inwardly of the flap from each of the cuts 99. The perforations 105 are positioned so as to be flush with the outer ends 106 of the dust flaps 98 in the completed box. Small V-shaped notches 107 extend inwardly from the outer edge 108 of the flap 97 at the perforations 105, which facilitates the tearing of the flap at the perforations. A recess 109 in the center part of the outer edge 108 of the flap 97 enables the portion between the perforations to be grasped at the time the flap is torn.

When the box is opened, the flap 96 is lifted upwardly, separating it from the flap 97 and removing segments 102 from within the cuts 99. Next, the center portion of the flap 97 is grasped and pivoted outwardly, causing the flap 97 to be torn apart at the perforations 105. This provides access to the interior of the box.

Upon reclosure, first the center portion of the flap 97 is returned to its original position. Then the flap 96 is pivoted downwardly to overlap the flap 97. As this occurs, the segments 102 are returned to the openings at the cuts 99. The segments 102 very readily enter the openings at the cuts 99, because the outer portions of the flap 97, beyond the perforations 105, are fully supported by the dust flaps 98. This means that there is no tendency for the outer portions at the cuts 98 to be pushed downwardly into the box, rather than receiving the segments 102 for holding the box closed.

Figure 30:
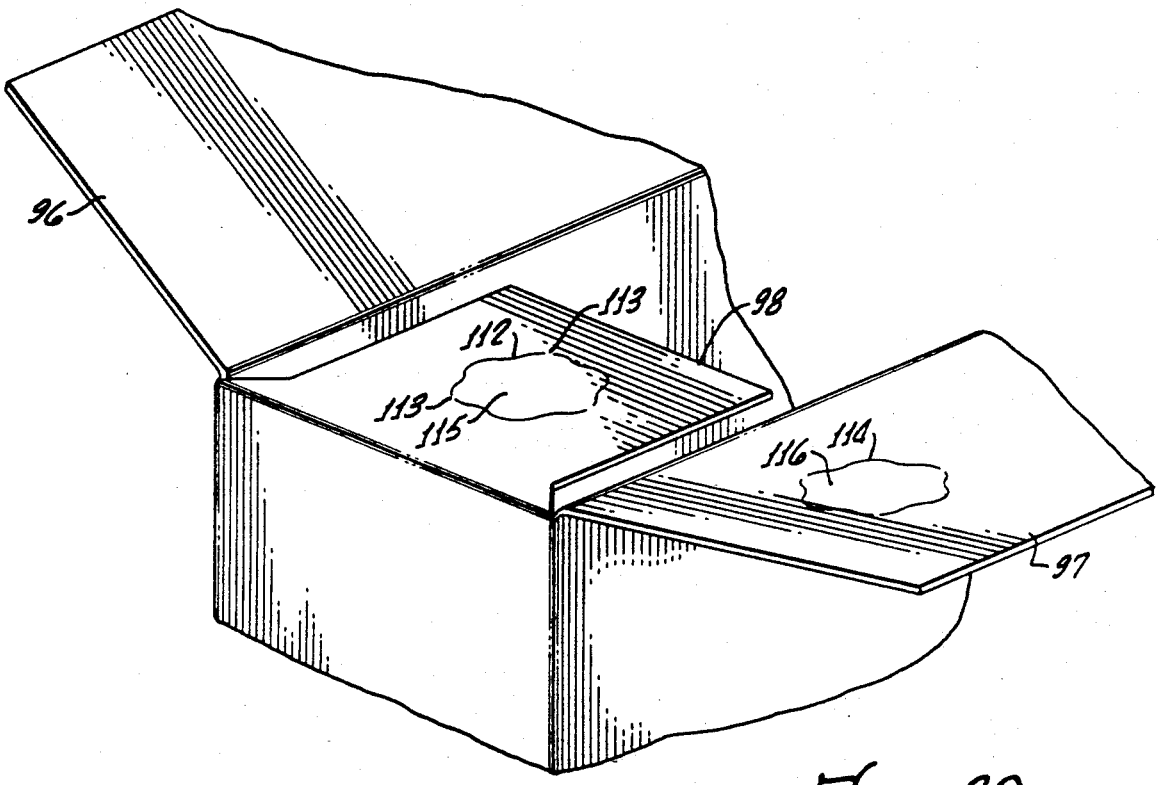
FIG. 30 is a fragmentary perspective view of a modified form of box closure, with the flaps separated.

In the version of FIG. 30, the dust flap 98 is glued to the flap 97, as before, but also is provided with a cut 112 entirely through the dust flap, except for small uncut segments 113. In this instance, the cut 112, while forming an enclosed pattern, is irregular, defined by a serrated or undulating line. A matching cut 114 is provided in the portion of the flap 97 that overlaps the dust flap 98. As the box is completed, a quantity of glue is applied between the center part 115 within the cut 112 and the center part 116 within the cut 114. The center part 116, in turn, is glued to the undersurface of the flap 96. Therefore, when the box is opened, the center parts 115 and 116 tear out of the cuts 112 and 114 and are retained by the outer flap 96. Upon reclosure of the box, the center parts 115 and 116 are returned to the cuts 112 and 114 to provide retention of the top flap 96. By having an undulating or serrated contour, the edges presented at the cuts 112 and 114, and the center parts 115 and 116, have a greater area in contact than do circular cuts and, consequently, generate more friction to improve the retention of the top flap.

Figure 31:
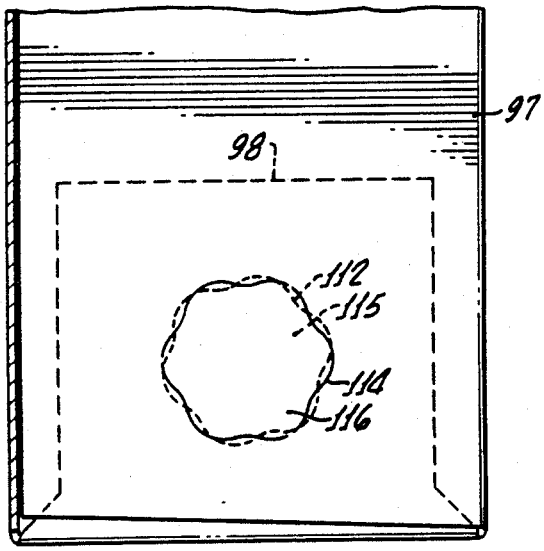
FIG. 31 is a fragmentary sectional view showing an arrangement for the closure flaps which provides increased resistance to separation of the flaps.

Even greater retention of the top flap is realized in the design of FIG. 31, where the cuts 112 and 114 are slightly misaligned rotationally. There are narrow areas of the flap 97 along the outside edge of the cut 114 that overlap the center part 115 within the cut 112 of the dust flap 98. This means that there is interference to the removal of the center part 115 from the cut 112. This will not prevent the center part 115 from being stripped from the cut 112 as the flap 96 is opened. However, upon closure of the flaps, the interfering portions of the flap 97 around the cut 114 provide a mechanical barrier which adds to the frictional force to give a greater resistance to removal of the center part 115 than in the previous embodiment. Therefore, the flap 96 is held more securely.

Figure 32:
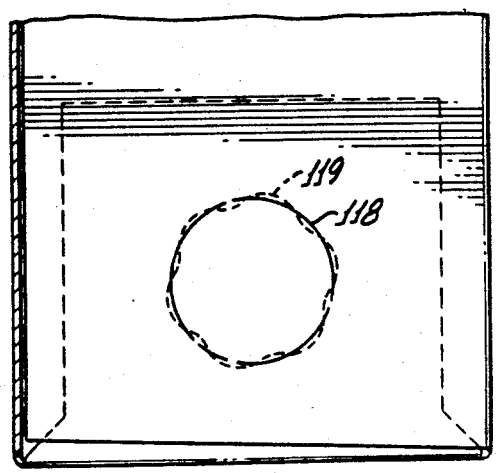
FIG. 32 is a view similar to FIG. 31 of another arrangement for providing increased resistance to the separation of the flaps.

Another version for improved retention of the flaps is shown in FIG. 32, where the cut 118 in the flap 97 is circular while the cut 119 in the dust flap 98 is undulating or serrated in shape. The lateral dimension of the cut 119 across the crests, but not the roots, of the cut is greater than the diameter of the cut 118. Consequently, there is an interference at the wider portions of the cut 119, resulting in a mechanical interference and a high retention force when the center parts within the cuts 119 are reintroduced into the peripheries of the cuts.

Figure 33:
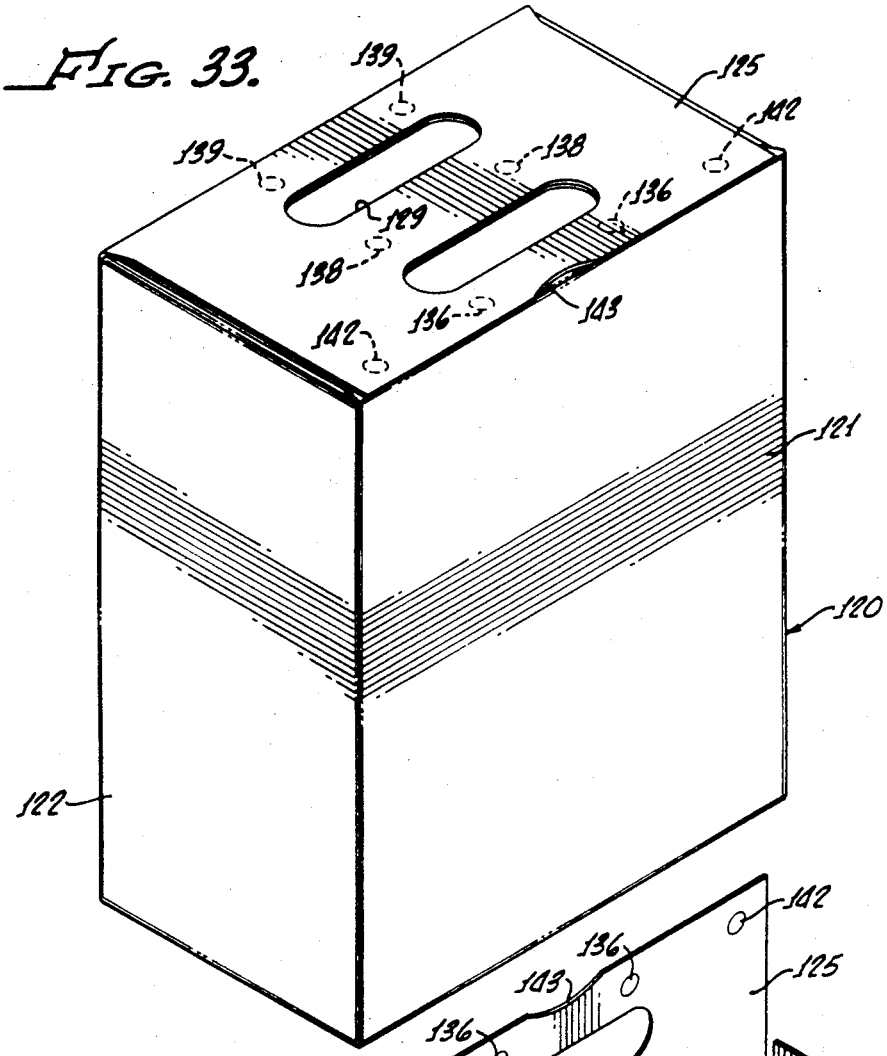
FIG. 33 is a perspective view of a box for beverage cans.
Figure 34:
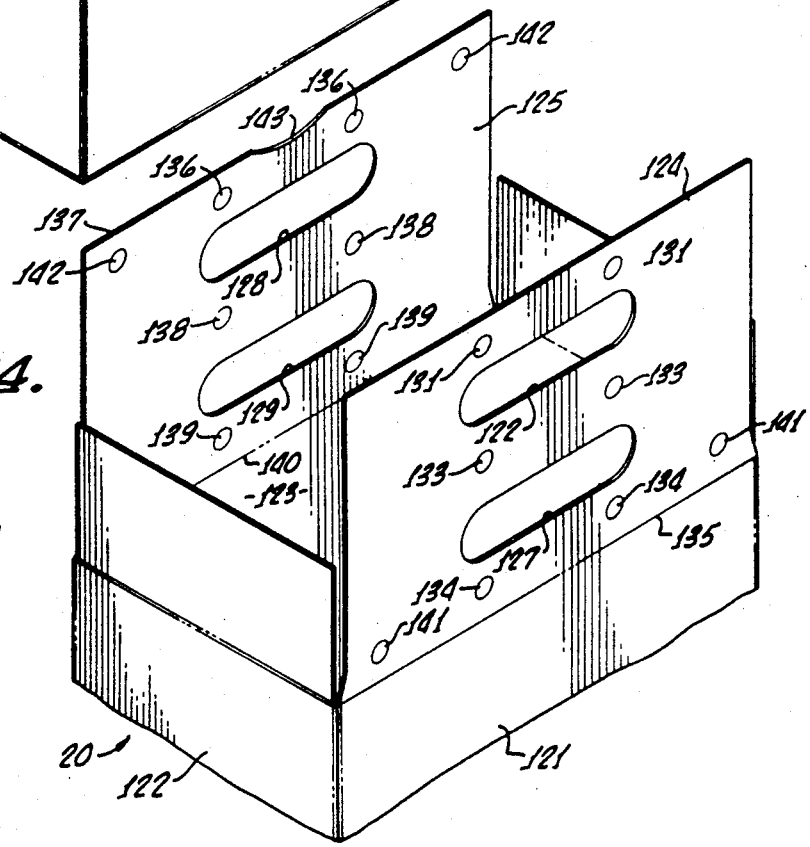
FIG. 34 is a fragmentary perspective view of the box of FIG. 33, shown with the flaps open.

The arrangement of FIGS. 33 and 34 is for use as a container for beverage cans, such as a package of twelve twelve-ounce cans. Here, the box 120 is of conventional construction, except at one end. The box includes front and back panels 121 and narrower opposed side panels 122. An opening 123 is at the top end of the box 120 to be closed by flaps 124 and 125. Each of the flaps 124 and 125 is as wide as the opening 123 so that when folded across the opening they overlap fully and provide a closure for the opening. In the embodiment illustrated, the flap 124 fits beneath the flap 125.

Two parallel elongated cutouts 126 and 127 are provided in the mid-portion of the flap 124. Similar cutouts 128 and 129 are formed in the flap 125. When the flaps 126 and 127 are folded across the opening 123, the cutout 126 in the flap 124 is in registry with the cutout 128 in the flap 125. Also, the cutout 127 in the flap 124 is in registry with the cutout 129 in the flap 125. These cutouts provide finger openings used when carrying the box 120.

Two circular cuts 131 partway through the thickness of the flap 124 are made in its outer surface, one being near either end of the cutout 126 and between that cutout and the outer edge 132 of the flap 124. Two similar cuts 133 are formed between the two cutouts 126 and 127. Two additional cuts 134 are between the ends of the cutout 127 and the inner edge 135 of the flap 124.

Corresponding partial cuts are formed in the undersurface of the flap 125 and positioned to be in registry with the cuts in flap 124 when the two flaps are superimposed. This includes cuts 136 near the outer edge 137 of the flap 125, cuts 138 between the cutouts 128 and 129, and additional cuts 139 adjacent the inner edge 140 of the flap 125.

Two additional partial cuts 141 are provided in the outer surface of the flap 124 adjacent the opposite ends of the inner edge 135 of that flap. Corresponding partial cuts 142 are formed in the inner surface of the flap 125 adjacent the opposite ends of the outer flap edge 137. When the flaps are folded across the opening 123, the cuts 142 register with the cuts.

When the box is to be closed, glue is applied to the interior of each of the patterns defined by the partial cuts in at least one of the two flaps 124 and 125. This secures the two flaps together to form a secure closure for the box. The portion of the box that is gripped for carrying it is stronger than in conventional designs because there is full overlapping of the two flaps and a glued connection on both sides of each of the cutouts. This provides resistance to tearing of the board at the cutouts. Despite the strength of the connection, the flaps are readily separated for removal of the contents of the box 120 by tearing the flap 125 away from the flap 124 so as to pull the fiber of the board away from one of the flaps at each of the registered partially cut patterns of the two flaps. A notch 143 may be provided in the center portion of the outer edge 137 of the flap 125 to facilitate grasping this flap and pulling it away from the other flap 124.

Figure 35:
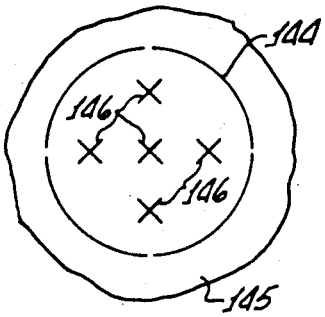
FIG. 35 is a fragmentary top plan view showing an arrangement for increasing the strength of the glue joint.

For added strength of the glue joint in any of the foregoing embodiments, the area within the cut may be perforated or otherwise cut to provide locations where glue can accumulate. In the embodiment of FIG. 35, a circular cut 144, through the flap 145, interrupted by uncut segments 146, defines the space where glue will be applied to secure the flap 145 to another flap. Within the cut 144 are additional cuts 147 in the form of X's. Glue will run into and around the cuts 147 in the completed joint so that there is an increased area exposed to the glue and a stronger connection than otherwise would be the case. Inasmuch as the glue generally will not extend to the periphery of the cut 144 for this type of glue joint, the cuts 147 are spaced inwardly from the periphery. This confines the additional cuts 147 to the locations that are sure to become covered with glue.

Cuts, such as those shown in FIG. 35, also may be provided in the flap that overlaps the flap 145 and positioned opposite from the cuts 147. This increases adhesion of the glue to both of the flaps.

The spout arrangement of FIGS. 36, 37 and 38 is particularly effective in providing for a secure reclosure of the spout opening. In this arrangement, the box is made of an integral sheet of cardboard formed so as to provide a side panel that includes an inner side panel 149 which is overlapped by an outer side panel 150. These panels are integral with the front and back panels, respectively, and the box is provided with top and bottom flaps in the usual manner. A dust flap 151 projects upwardly from the panel 150 and is bent at 90 degrees in the completed box in the conventional manner. A slightly larger flap 152 projects from the end of the inside panel 149. The flap 152 is bent through 180 degrees about a transverse score 153 formed at the juncture between the panel 149 and the flap 152. When doubled over the inside of the flap 149, the panel 152 is glued in the position illustrated in FIG. 38.

A generally bell-shaped cut 154, wider at the bottom than at the top, is made through the panel 149. The center portion 155 within the cut 154 is held in place by two small uncut segments 156 and 157 on opposite sides of the cut. The uncut segment 156 is near the top of the cut, and the uncut segment 157 is near the bottom of the cut.

A cut 158 is formed in the flap 152 and made to be of the same size and shape as the cut 154. However, the cut 158 is positioned with its smaller end downwardly, as illustrated in FIG. 36, so that it will register with the cut 154 when the flap 152 is doubled over the panel 149. A quantity of glue 159 holds the center portion 160 within the cut 158 to the undersurface of the center portion 155. Opposite uncut segments 161 and 162 interconnect the center portion 160 with the remainder of the flap 152 and keep the portion 160 in position during the manufacturing operation. The uncut segment 161 is near the wider end of the cut 158, and the uncut segment 162 is near the narrower end of the cut. This means that the uncut segments 161 and 162 are spaced from the uncut segments 156 and 157 of the panel 149 when the flap 152 is doubled over.

A cut 163 in the panel 150 provides a closure flap 164. This flap is connected to the remainder of the panel 150 at a transverse score 165 at its upper end, which permits the flap 164 to be pivoted upwardly. The bottom edge 166 of the closure flap 164 is spaced a short distance from the bottom edge 167 of the cut 164, thereby leaving a narrow opening through the panel 150 to permit the bottom edge of the closure flap 164 to be engaged for opening the closure flap. A transverse score 168 extends across the closure flap 164 just below the bottom of the cut 154 and adjacent the bottom edge 166 of the closure flap. This enables the bottom portion of the closure flap 164 to bend outwardly when the closure flap is raised, as seen in phantom in FIG. 35. This avoids curling or otherwise distorting the contour of the remainder of the closure flap 164 when it is pivoted away from the flap 152 to the open position. Cracking of the flap 164 is avoided.

Small uncut segments 169 and 170 at opposite positions on the cut 163 connect the closure flap 164 to the panel 150. In addition, glue 159 secures the underside of the closure flap 164 to the outer surface of the center portion 155 within the cut 154 in the inner side panel 149.

In use of the embodiment of FIGS. 36, 37 and 38, the closure flap 164 is lifted so as to pivot about the transverse score 165 as the uncut segments 169 and 170 are readily severed. This strips the center portions 155 and 160 from within the cuts 155 and 158, respectively. The uncut segments 156, 157, 161 and 162 are broken as this occurs. Consequently, the center portions 155 and 160 move with the closure flap 164 as the latter is pivoted away from the side panel 150 of the box. This exposes axially aligned openings of the same size at the cuts 154 and 158, so that the contents of the box may be dispensed by pouring through the spout opening.

Smoother separation occurs by spacing the uncut segments 156 and 157 in the panel 149 from the uncut segments 161 and 162 in the flap 152. These segments are not all broken at once as the flap 164 is raised.

The closure flap 164 subsequently is returned to its original position, which thereby inserts the center portion 155 back within the cut 154, and the center portion 160 within the cut 158. The result is a particularly great frictional force retaining the closure flap 164 in its closed position. This occurs because of the presence of the two cut out center portions 155 and 160, which are substantially the same size, and is greater than the retention force exhibited by the flaps of the previously-described embodiments. In the arrangement of FIGS. 36, 37, and 38 the inner center portion 160 not only can create friction at the periphery of the cut 158, but also at the periphery of the cut 154, in resisting outward movement of the closure flap. In fact, as long as there are two thicknesses at the center portion of the opening which are substantially of the same dimension, an effective retention will be accomplished, even in the absence of the remainder of the doubled over flap 152. The closure flap 164 will lock securely into position, effectively sealing the box openings, after repeated uses.

The flap 152 must be given a precise bend at the score 153 in order to assure accurate registry of the cut 158 with the cut 154 in the side panel 149. If the bend is at a slight angle, or does not occur exactly at the midpoint between the cuts 154 and 158, the center 155 within the cut 154 will not be fully aligned with the center 160 within the cut 158. This will make the closure flap 164 harder to loosen to open the spout, as well as making reclosure more difficult.

A very accurate bend is accomplished if a cut is made partially through the outside of the board before the board is scored. This is illustrated in FIG. 39 where a cut 172 is made partway through the board all along the juncture between the flap 152 and the side panel 149. This cut is made while the board is flat in the manufacturing process, and can be located very accurately in the middle between the cuts 154 and 158. The cut 172 also can be made at an exact 90° angle relative to an imaginary line interconnecting the centers of the portions 155 and 160 within the cuts 154 and 158.

The score 153 then is formed over the cut 172. This is a reverse score, bulging outwardly in a ridge on the side of the board which is on the outside of the bend that is to be made. A groove is formed in the other side opposite from the cut 172. As the score is made, the material of the board becomes compacted and strengthened at the vicinity of the cut 172. When the flap 152 subsequently is doubled over the side panel 149, the bend will occur exactly along the line of the cut 172. Therefore, the cuts 154 and 158, along with the center parts 155 and 160, will be given a high degree of registry. Consistent results are obtainable during high speed production runs.

The spout of the type shown in FIGS. 36–38 is equally effective when formed in other portions of the box, such as in the top. The construction then is similar to that illustrated in FIG. 19, except that the cut 66 is made to the same size and shape as that of the cut 55, and the center part 67 is positioned in registry with the center part 57. At the locations of the bends there may be partial cuts with scores over them to assure accuracy of bend and precise registration of the center parts.

Adherence of the center portions within the cuts in the inside layers to the inner surface of the closure flap is, of course, essential to the retention of the closure flap in the closed position. If the portions from within the cuts come loose from the closure flap, they cannot be reinserted within the openings to create friction that will hold the closure flap. A glue joint of enhanced strength results from the arrangement of FIGS. 41 and 42. Here the closure flap 173 formed in the outer side panel 174 is provided with a circular embossment 175. The embossment 175 is smaller than the cut 177 that defines the flap 173, and is spaced inwardly from the cut. The projecting portion of the embossment 175 is on the inside of the closure flap 173, resulting in a shallow indentation in the outside of the flap.

Aligned with the embossment 175 in the completed box is a circular opening 178 in the inner side panel 179. This opening is made slightly larger than the embossment, but smaller than the center part 180 within the cut 181 in the panel 179. The opening 178 is spaced inwardly of the cut 181. When the box is assembled, the embossment 175 enters the opening 178. The embossment and opening preferably are proportioned so that some compression occurs around their peripheries as the embossment enters the opening. Glue 182 within the opening 178 engages the embossment 175 and is located also between the center part 180 and the flap 173 beyond the opening 178.

The resulting glue joint, by including the embossment 175 within the opening 178, is particularly strong so that the center part 180 will adhere securely to the inner surface of the closure flap 173. The board is compressed to some extent when the embossment 175 is formed, making the closure flap 173 stronger and more resistant to cracking.

Preferably, an additional embossment 183 is provided on the inner flap 184 within the cut 185 for the spout opening in that element. The embossment 183 is positioned to project outwardly when the flap 184 is doubled over the inner side panel 179, and is located so as to enter the opening 178 in the same manner as the embossment 175 but from the opposite end of the opening 178. Each of the two embossments 175 and 183 extends approximately halfway, or nearly halfway, through the thickness of the board, making up the inner side panel 179. Therefore, the embossments 175 and 183 meet, or nearly meet, at the center of the opening 178. The glue 182, filling the remaining space in the opening 178, effectively holds the center part 186 within the cut 185 in the flap 184 to the center part 180 within the cut 181 in the panel 179. Both center parts 180 and 186 are securely held to the inner surface of the closure flap 173.

The spout arrangement of FIGS. 43–47, provides a double thickness for the closure flap of the spout and added strength to minimize the possibility of tearing the box above the closure flap as it is pulled upwardly. As illustrated, the box 188 is made from an integral sheet which includes an inner end panel 189 connected to one side panel 190 and an outer end panel 191 connected to the other side panel 192. These two end panels overlap and are glued together in the completed box. A dust flap 193 projects from the upper edge of the outer end panel 191 and fits beneath the overlapping top flaps 194 and 195 in the completed box. The inner end panel 189 is provided with a score 196 at its upper edge beyond which is a flap 197. A circular cut 198 is made through the flap 197 providing a hole center 199 which is connected to the remainder of the flap 197 by a small uncut portion or nick 200. The uncut segment 200 is close to the score 196, which means that it is in the bottom of the cut at the 6 o'clock position in the flat pattern of the box.

Figure 49:
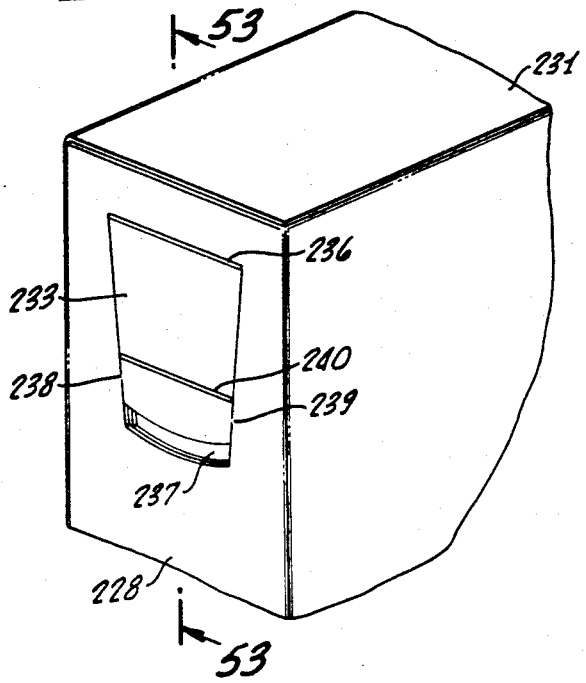
FIG. 49 is a fragmentary perspective view of a modified box in which there are four layers at the spout.
Figure 50:
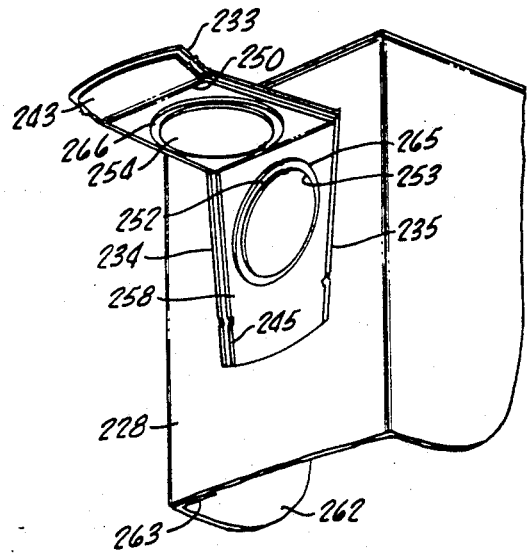
FIG. 50 is a fragmentary perspective view of the box of FIG. 49 with the spout in the open position.

A beveled punch 202, shown in FIG. 49, is used in making the cut 198. This punch has an inside beveled surface 203 that leads to the outer cutting edge 204. A small notch 205 provides the uncut nick 200. As viewed in FIG. 43, the cut 198 is formed by striking the flap 197 on the reverse side.

Below the score 196 is the inner portion 207 of the closure flap for the spout. This is defined by a transverse score 208 at the upper edge of the flap from the outer edges of which extend two cuts 209 and 210, which are convergent downwardly. These cuts are connected at the bottom edge 211 of the closure flap 207, which is convexly curved. A cutout slot 212 is located below the edge 211. Small uncut segments 213 and 214 in the cuts 209 and 210, respectively, connect the flap 207 to the remainder of the panel 189 near the bottom edge of this flap. A transverse score 215 is provided in the flap 207 above the uncut segments 213 and 214.

The outer closure flap 217 in the outer end panel 191 is similar to the flap 207 but slightly wider and longer. The flap 217 is defined by a score 218 at its upper edge and by downwardly convergent cuts 219 and 220 along its side edges. A cutout 221 is beneath its curved bottom edge 222. Uncut segments 223 and 224 interrupt the side cuts 219 and 220 near the bottom edge. Above these uncut segments is a transverse score 225 in the flap 217.

In the completed box as shown in FIG. 45, the flap 197 is bent at the score 196 and doubled over the inner end panel 189 and glued to it along the side edges of the flap 197. This positions the hole center 199 immediately inward of the closure flap 207 above the transverse score 215. A quantity of glue 226 bonds the hole center 199 to the undersurface of the closure flap 207. When the flap 197 is doubled over the inner end panel 191 in this manner, the uncut segment 200 becomes positioned at the top adjacent the upper edge of the flap 207. Also, the beveled cut 198 becomes positioned so that the larger end of the bevel is at the inside of the box, as best seen in the enlarged view, FIG. 47.

The outer end panel 191 fits over the inner end panel 189 and is glued to the latter along the side edges of these panels. An additional quantity of glue 226 secures the outer closure flap 217 to the inner closure flap 207. The result is an integral unit. The closure is tamperproof by virtue of the connections at the uncut segments 213 and 214 for the inner flap 207 and 223 and 224 for the outer closure flap 217. In this assembly, the score 208 at the upper end of the inner closure flap 207 is slightly below the score 218 of the outer closure flap 217. This is to enable the flaps 207 and 217 to pivot freely when the box is opened.

When the box is to be opened, the two closure flaps 207 and 217 are grasped at their lower edges 211 and 222 through the cutouts 212 and 221, and these flaps are pulled upwardly. This severs the nicks 213, 214, 223 and 224, freeing the lower ends of the flaps to rotate upwardly about the scores 208 and 218 at their upper edges. As this rotational movement of the closure flaps takes place, they will normally bend at the transverse scores 215 and 221, leaving the hole center 199 undistorted. The upward pivoting of the closure flaps 207 and 217 pulls the hole center 199 from the cut 198, severing it from the flap 197 at the nick 200. The location of the uncut nick 200 at the upper end of the cut 198 facilitates the removal of the hole center 199 so that it will separate cleanly and easily at the uncut segment 200 and will not tear.

Because the closure flap is defined by the two layers 207 and 217, it is stronger than the single layer closure flaps in the previously described embodiments. This resists a tendency to tear the box end panels at the upper end of the closure flap. In the embodiment of FIGS. 36–38, for example, an excessively hard pull on the closure flap 164 can cause the end panel 150 to tear between the closure flap and the dust flap 151. This is avoided in the embodiment of FIGS. 43–47 because there are two closure flaps connected to two end panels to resist such tearing.

When the spout of FIGS. 43–47 is returned to the closed position, the center 199 is reinserted into the cut 198. It will snap into place and be held effectively because of the undercut on the hole center 199 resulting from the beveled cut. The larger edge of the tapered cut, entering the opening 198, tends to hold the hole center 199 in place within the opening and the closure flaps 207 and 217 flush with the end panels.

If desired, the cuts 209 and 210 may be continuous so that the uncut segments 213 and 214 are omitted for the inner closure flap 207. The outer closure flap 217 then provides the tamper proof retention of the spout closure.

In the arrangement of FIGS. 50–56, four layers are provided at the spout. This provides exceptional strength and rigidity at that portion of the box, as well as excellent retention in the closed position. The outer end panel 228 of the box resembles the outer end panel 191 of the version of FIGS. 43–47. Accordingly, it has a dust flap 229 at its upper edge with a transverse score 230 to permit bending of the dust flap beneath the top panels 231 and 232 of the completed box. A closure flap 233 is formed in the end panel 228 defined by tapered side cuts 234 and 235, a transverse score 236 at its upper end and a cutout 237 at its lower end. Uncut nicks 238 and 239 beneath a transverse score 240 hold the bottom portion of the closure flap 233 to the end panel 228.

The other end panel 242 fits inside the end panel 238 in the completed box and is provided with a closure flap 243 which is similar to the closure flap 233 but slightly smaller. The closure flap 243 is connected to the end panel 242 at its upper edge, where there is a score 244. Converging side cuts 245 and 246 extend to a bottom cutout 247. Uncut nicks 248 and 249 hold the lower portion of the closure flap 243 to the end panel 242. There is a transverse score 250 on the closure flap 243 which corresponds to the location of the score 240 and the flap 233 when the box is assembled.

At the upper edge of the end panel 242 is a flap 252 which is similar to the flap 197 of the embodiment of FIGS. 43–47. A circular cut 253 through the flap 252 results in a hole center 254 held to the remainder of the flap by an uncut nick 255. This uncut segment is adjacent the score 256 that connects the flap 252 to the remainder of the end panel 242, meaning that it is at the bottom prior to the assembly of the box.

Figure 51:
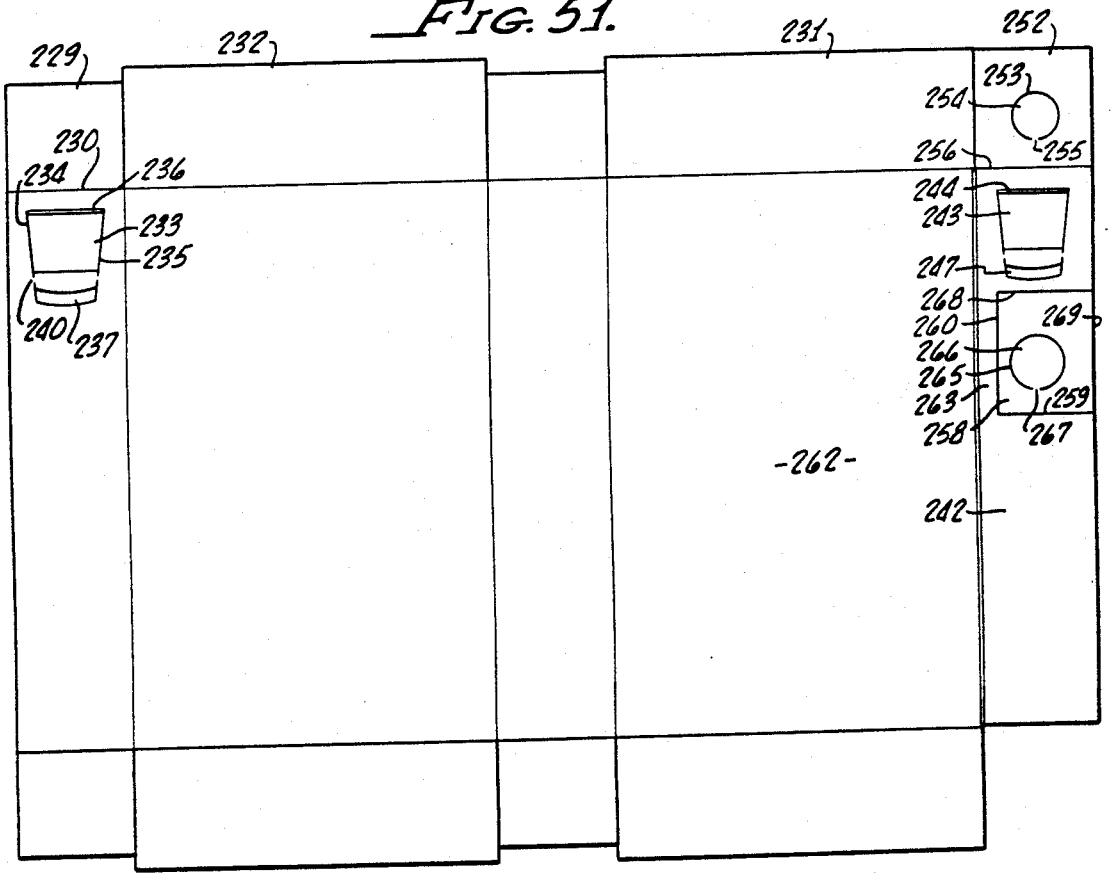
FIG. 51 is a plan view of the flat pattern of the box of FIGS. 49 and 50.

An additional flap 258 is provided below the closure flap 243. The flap 258 is defined by a transverse cut 259 in the end panel 242 and a longitudinal cut 260, the latter being spaced laterally inwardly of the inner edge of the end panel 242 where it is connected to the side panel 262 of the box (see FIG. 52). The result is a narrow portion 263 of the end panel 242 adjacent the flap 258 which acts as a glue flap. A circular cut 265 is provided in the flap 258, with the hole center 266 held to the remainder of this flap by an uncut nick 267. The latter is opposite from the transverse score 268 between the flap 258 and the end panel 242, so that it is at the six o'clock position in the flat pattern of the box, as shown in FIG. 51. The cut 265 is of slightly smaller diameter than that of the cut 253 in the flap 252. In order for the glue flap 263 to be of adequate width to permit a secure attachment between the end panel 242 and the undersurface of the end panel 228, the cut 265 may be off center toward the outer edge 269 of the flap 258, as a result of which the cut 265 is slightly displaced from the longitudinal axis of the end panel 242. The cut 253 in the flap 252 is similarly positioned.

In the completed box, the flaps 252 and 258 are folded behind the closure flap 243 of the end panel 242 and glued in that position. The flap 258 is rotated upwardly about the score 267 and the flap 252 is rotated downwardly about the score 256. It is preferred to pivot the flap 258 first so that it is adjacent the closure flap 243 and the flap 252 is on the inside. A quantity of glue 270 attaches the hole center 254 to the hole center 266 and an additional quantity of the glue 270 connects the hole center 266 to the undersurface of the closure flap 243. Glue 270 also secures the closure flap 243 to the closure flap 233, the latter being on the outside. Both uncut nicks 255 and 267 move to the upper, or 12 o'clock position when the flaps 252 and 258 are doubled over the end panel 242 in this manner.

The spout is opened by pulling outwardly on two closure flaps 233 and 243, which are conveniently grasped at the cutouts 237 and 247. The combined closure flaps may bend about the transverse scores 240 and 250. As the closure flaps 233 and 243 are rotated upwardly about the scores 236 and 244 to the position shown in FIG. 55, the hole centers 254 and 266 are pulled from the cuts 253 and 265. They are readily torn away at the nicks 255 and 267 when this is done.

The cuts 253 and 265 are formed by a beveled punch similar to the punch 202 illustrated in FIG. 49. In the embodiment illustrated, the cuts 253 and 265 are made on opposite sides of the board making up the box so that the hole center 254 has an undercut edge when it is removed from the cut 265. This is similar to the undercut provided for the hole center 199 in the previously described embodiment. As a result, the hole center 254 will tend to adhere to the edge of the cut 265 upon reclosure, effectively holding the spout in the closed position.

For even greater retention of the spout in the closed position, although with possible greater resistance to the opening of the box, the cut 265 may be similar to the cut 253 to provide the hole center 266 with an undercut edge. As a result, both hole centers will tend to stick in place when the spout is returned to the closed position.

The flat pattern for the box may be cut as illustrated in FIG. 57, which shows two flat patterns together resulting in a nesting of the flat patterns and a saving of board in the manufacture. The flat pattern of FIG. 57 is the same as that of FIG. 51 except that the longitudinal cut **260*a* for creating the flap 258 is extended to the bottom edge of the end panel 242. The result is a narrow gluing strip 263*a* along the inside end panel extending not only alongside the flap 258 but also beneath it. This enables the adjoining flat pattern of the box to be inverted and nested into the portion of the end panel 242 removed in this manner. As a result, the end panel 242 out of one flat pattern fits beneath the end panel 242** of the other end panel and the amount of board consumed in making the box is minimized.

This technique also may be followed in constructing the embodiment of FIGS. 43–47.

The container may be made waterproof and siftproof when constructed as illustrated in FIGS. 58 and 59. Here the box is the same as that of the FIGS. 43–47 embodiment except for the opening cut in the flap 197. In the design of FIG. 58, a double cut is made in the flap 197. One cut 271 penetrates partially through the flap 197, about half of its thickness, on what is the inside of the flap in the completed box. The other cut 272 penetrates the flap 197 a similar distance from the other side of the flap. The cut 272 is larger than the cut 271 so that there is a narrow uncut strip 273 between the two cuts and the flap 197 presents an impervious barrier between the inside and the outside of the box. Liquids or fine powders will be retained without leakage.

Both of the cuts 271 and 272 are continuous, leaving no uncut nicks as in the previously described embodiments. Glue 226 holds the flap 207 to the portion of the flap 197 within the cut 272.

When the box is opened, as shown in FIG. 59, the board will tear at the strip 273 between the cuts 271 and 272, and the center within these cuts will be removed, resulting in a single opening through which the contents of the box may be dispensed.

This same type of arrangement may be applied to the four-layer version of FIGS. 50–56.

The foregoing detailed description is to be clearly understood as given by way of illustration and example only, the spirit and scope of this invention being limited solely by the appended claims.

What is claimed is:

1. A box having a spout comprising:

a sheet of fibrous material defining an enclosure which includes two side panels and two end panels, one of said end panels having overlapping layers including a first outside layer and a second layer inside of said first layer, said first layer having a transverse upper edge and a transverse lower edge, and including a first closure flap intermediate said upper and lower edges, said first closure flap being integral with and connected to said first layer at a transverse upper edge thereof parallel to and inwardly of said upper edge of said first layer, said material having a first score along said upper edge of said first closure flap whereby said first closure flap is pivotal about said first score, said first score having opposite ends and defining a portion of the periphery of said first closure flap, said first layer having a cut therethrough extending from the opposite ends of said first score for defining the remainder of the periphery of said first closure flap, said second layer having a transverse upper edge and a transverse lower edge and including a second closure flap intermediate said upper and lower edges of said second layer, said second closure flap being integral with and connected to said second layer at a transverse upper edge thereof parallel to and inwardly of said upper edge of said second layer, said material having a second score along said upper edge of said second closure flap whereby said second closure flap is pivotal about said second score, said second score having opposite ends and defining a portion of the periphery of said second closure flap, said second layer having a cut therethrough extending from the opposite ends of said second score for defining the remainder of the periphery of said second closure flap, a third flap integral with said second layer and projecting from said upper edge of said second layer, said material having a third score along said upper edge of said second layer and being bent so that said third flap is doubled over the inner surface of said second layer and forms a third layer, said third layer having a cut therethrough forming the periphery of an opening except for at least one frangible uncut segment interconnecting the parts of said third layer within said periphery with the portion of said third layer outside of said periphery, said second closure flap overlying said part of said third layer, a quantity of glue between said first closure flap and said second closure flap for connecting the same together, and a quantity of glue between said second closure flap and said part of said third layer within said periphery of said opening therein, whereby said first closure flap and said second closure flap can be pivoted upwardly together about said first and second scores, thereby severing said frangible segment and pulling out said part of said third layer within said periphery of said cut in said third layer.

2. A device as recited in claim 1, in which said first closure flap includes a fourth transverse score adjacent the bottom edge thereof and below said cut in said third layer, and said second closure flap includes a fifth transverse score aligned with said fourth transverse score, whereby said first closure flap and said second closure flap can be bent intermediate the ends thereof.

3. A device as recited in claim 1 in which said second closure flap is smaller than said first closure flap.

4. A device as recited in claim 1 in which said first layer has an opening at the bottom edge of said first closure flap and said second layer has an opening at the bottom edge, of said second closure flap, for thereby enabling said first and second closure flaps to be grasped for being pivoted upwardly.

5. A device as recited in claim 1 in which said cut in said first layer includes spaced side portions interconnected by a bottom portion, said first layer having frangible uncut segment interrupting each of said side portions adjacent but inwardly of said bottom portion of said cut therein, whereby said first closure flap is held in position but can be so pivoted upwardly by severing said uncut segments in said first layer.

6. A device as recited in claim 1 in which said cut in each of said first layer and said second layer includes spaced side portions interconnected by a bottom portion, each of said first and said second layers having a frangible uncut segment interrupting each of said side portions adjacent but inwardly of said bottom portion of said cut therein, whereby said first and second closure flaps are held in position but can be so pivoted upwardly by severing said frangible uncut segments in said first and second layers.

7. A device as recited in claim 1 in which said second score is slightly below said first score.

8. A device as recited in claim 1 in which said first layer has a first longitudinal edge attached to one of said side panels, and said second layer has a second longitudinal edge attached to the other of said side panels.

9. A device as recited in claim 1 in which said frangible uncut segment is at the upper end of said cut in said third layer.

10. A device as recited in claim 1 in which said third layer has a beveled edge such that said part of said third layer within said periphery has an undercut edge, for thereby providing retention when said part is returned to said cut in said third layer.

11. A device as recited in claim 1, in which said second layer is provided with an additional cut so as to define a fourth flap, said fourth flap being bent upwardly so as to lie adjacent said third layer and form a fourth layer, said fourth layer having a cut therethrough forming the periphery of an additional opening except for a frangible uncut segment interconnecting the part of said fourth layer within said periphery of said cut in said fourth layer, with the portion of said fourth layer outside of said periphery, said part of said fourth layer within said periphery of said additional opening being substantially aligned with said part of said third layer within said periphery of said cut in said third layer, and including a quantity of glue between said part of said third layer within said periphery of said cut in said third layer and said part of said fourth layer within said periphery of said cut in said fourth layer, whereby when said closure flaps are so pivoted said frangible segment of said fourth layer is severed and said part of said fourth layer is pulled out of said periphery of said cut in said fourth layer.

12. A device as recited in claim 11 in which for forming said fourth flap said second layer includes a cut spaced beneath said second closure flap and extending longitudinally of said second layer, said material having a score transversely of said second layer extending from one end of said last mentioned cut extending transversely of said second layer.

13. A box having a spout comprising:

a sheet of fibrous material defining an enclosure which includes two side panels and two end panels, one of said end panels including:

outside part and an inside part, said inside part including a first upper end portion and a second portion depending therefrom, said first and second portions being connected along one edge thereof to one of said side panels, said first portion having an upper edge and a lower edge, a first flap projecting from said upper edge of said first portion, a second flap depending from said lower edge of said first portion, said first flap and said second flap being in an overlapping relationship and doubled over said first portion, said first flap having a cut therethrough forming the periphery of an opening except for at least one frangible uncut segment interconnecting the part of said first flap within said periphery with the portion of said first flap outside of said periphery, said second flap having a cut therethrough forming the periphery of an opening except for at least one frangible uncut segment interconnecting the part of said second flap within said periphery with the portion of said second flap outside of said periphery of said cut in said second flap, said portions of said first and second flaps within the peripheries of said cuts therein being in alignment, said first portion including a closure flap overlying said parts of said first and second flaps within said peripheries of said cuts therein, said outside part of said one end panel overlapping said inside part of said one end panel and having a closure flap aligned with and overlying said closure flap of said first portion of said inside part, a quantity of adhesive securing said closure flap of said outside part of said one end panel to said closure flap of said first portion of said inside part, a quantity of adhesive securing together said parts of said first and second flaps within the peripheries of said cuts therein, and a quantity of adhesive securing said parts of said first and second flaps within the peripheries of said cuts therein to said closure flap of said first portion of said inside part, whereby movement of said closure flaps removes said parts of said first and second flaps from the peripheries of said cuts therethrough to provide a dispensing opening for said enclosure, and reverse movement of said closure flaps returns said parts of said first and second flaps to said peripheries of said cuts therethrough.

14. A device as recited in claim 13 in which said first flap overlaps said second flap.

15. A device as recited in claim 13 in which said second portion is relatively narrow, being narrower than said first flap.

16. A device as recited in claim 15 in which the combined widths of said second portion and said second flap are substantially equal to the width of said first flap.

17. A device as recited in claim 13 in which the opposite edge of said first portion is aligned with the outer edge of said second flap.

18. A device as recited in claim 13 in which said second flap is spaced from said one side panel.

19. A device as recited in claim 13 in which one of said flaps is on the inside of said enclosure, said cut in said one flap having a beveled edge such that said part of said one of said flaps within said periphery of an opening therein has an undercut edge, for thereby providing retention when said part of said one of said flaps is returned to said cut in said one of said flaps.

20. A device as recited in claim 19 in which said cuts in both said first and second flaps have beveled edges.

21. A box having a sealed opening comprising:

a sheet of fibrous material defining an enclosure which includes two side panels and two end panels, one of said end panels including an outside part having an underside overlying an inside part, said outside part having a cut therein defining a flap pivotal about one edge to a raised position, said inside part having a first cut extending partially through said sheet from one side of said inside part and defining the periphery of a first aperture, and having a second cut therein extending partially through said sheet from the opposite side of said inside part and defining the periphery of a second aperture which is larger than said first aperture, said first and second apertures being aligned so as to provide a relatively narrow uncut strip between said first cut and said second cut so that there is no communication through said first and second apertures, and a quantity of adhesive connecting the underside of said flap to said inside part within the peripheries of said first and second cuts, whereby when said flap is so pivoted said sheet will tear at said relatively narrow strip and said apertures will be opened.

22. A device as recited in claim 21 in which said one side of said inside part faces said enclosure and said opposite side of said inside part faces said flap.

23. A device as recited in claim 21 including an additional portion of said sheet overlapping said outside part, said additional portion having a cut therein defining a second flap pivotal about one edge of a raised position, said second flap being aligned within said first mentioned flap, and a quantity of adhesive connecting said second flap to said first mentioned flap to result in a unitary flap having two thicknesses.

* * * * *